US011548041B2

(12) United States Patent
Jasper et al.

(10) Patent No.: US 11,548,041 B2
(45) Date of Patent: Jan. 10, 2023

(54) APPARATUS AND METHOD FOR CLEANING MACHINES

(71) Applicant: Robowash Pty Ltd., Henderson (AU)

(72) Inventors: Frank Raymond Jasper, Henderson (AU); John Snell Jacob, Henderson (AU)

(73) Assignee: ROBOWASH PTY LTD., Henderson (AU)

( * ) Notice: Subject to any disclaimer, the term of this patent is extended or adjusted under 35 U.S.C. 154(b) by 228 days.

(21) Appl. No.: 16/883,200

(22) Filed: May 26, 2020

(65) Prior Publication Data

US 2020/0282434 A1 Sep. 10, 2020

Related U.S. Application Data

(63) Continuation of application No. 15/600,505, filed on May 19, 2017, now abandoned.

(Continued)

(51) Int. Cl.

*B08B 3/04* (2006.01)
*B08B 3/14* (2006.01)

(Continued)

(52) U.S. Cl.

CPC ..... *B08B 3/047* (2013.01); *B08B 3/024* (2013.01); *B08B 3/14* (2013.01); *B05B 1/14* (2013.01);

(Continued)

(58) Field of Classification Search

CPC B08B 3/14; B08B 3/024; B08B 3/047; B08B 3/02; B08B 2203/02; B08B 13/00;

(Continued)

(56) References Cited

U.S. PATENT DOCUMENTS 2,307,363 A 1/1943 Dunham
2,592,857 A 4/1952 Chadwick (Continued)

FOREIGN PATENT DOCUMENTS

CN 2542507 Y 4/2003
CN 102015130 A 4/2011

(Continued)

OTHER PUBLICATIONS

A First Office Action issued by the Chinese Patent Office dated Jul. 12, 2021 in connection with Chinese patent application No. 201780077245.6.

(Continued)

*Primary Examiner* — Benjamin L Osterhout
(74) *Attorney, Agent, or Firm* — Baker & McKenzie

(57) ABSTRACT

The present disclosure may provide a cleaning apparatus for cleaning parts. The cleaning apparatus may comprise a housing defining a washing chamber having an opening through which parts may be loaded/unloaded into the washing chamber. The cleaning apparatus may also comprise a spray system adapted to direct a washing solution to clean the part in the washing chamber. The spray system may comprise a spray array with at least one rotatable spray head. The spray head may comprise a plurality of nozzles through which the washing solution is directed to clean the part in the washing chamber. The cleaning apparatus may also comprise a closure which may provide controlled access to the washing chamber through the opening and may be movable between a closed position to sealingly close the opening and an open position so as to allow for loading and unloading of parts into the washing chamber without obstruction.

14 Claims, 17 Drawing Sheets

Related U.S. Application Data

(60) Provisional application No. 62/340,286, filed on May 23, 2016.

(51) Int. Cl.

| | |
|---|---|
| ***B08B 3/02*** | (2006.01) |
| *B05B 1/14* | (2006.01) |
| *B05B 1/26* | (2006.01) |
| *B05B 3/06* | (2006.01) |
| *B05B 3/04* | (2006.01) |
| *B08B 13/00* | (2006.01) |

(52) U.S. Cl.
CPC ..... *B05B 1/267* (2013.01); *B05B 3/0422* (2013.01); *B05B 3/06* (2013.01); *B08B 3/02* (2013.01); *B08B 3/04* (2013.01); *B08B 3/045* (2013.01); *B08B 13/00* (2013.01); *B08B 2203/02* (2013.01); *B08B 2220/04* (2013.01)

(58) Field of Classification Search
CPC ..... B08B 2220/04; B08B 3/045; B08B 3/04; B05B 3/0422; B05B 1/267; B05B 3/006; B05B 1/14
See application file for complete search history.

(56) References Cited

U.S. PATENT DOCUMENTS

| | | | |
|---|---|---|---|
| 2,884,203 | A | 4/1959 | Broughton |
| 3,016,841 | A | 1/1962 | Albertson et al. |
| 3,439,689 | A | 4/1969 | Zadron et al. |
| 3,452,763 | A | 7/1969 | Ballard |
| 3,499,792 | A | 3/1970 | Veith |
| 4,676,261 | A | 6/1987 | Blaul |
| 4,995,409 | A | 2/1991 | Watts |
| 5,149,441 | A | 9/1992 | Welch, II et al. |
| 5,277,208 | A | 1/1994 | Mansur |
| 5,482,064 | A | 1/1996 | Goddard |
| 5,640,981 | A | 6/1997 | Niemela et al. |
| 5,672,212 | A | 9/1997 | Manos |
| 6,044,852 | A | 4/2000 | Epperson, Jr. et al. |
| 7,191,489 | B1 | 3/2007 | Heath |
| 2002/0170978 | A1 | 11/2002 | Mohn |
| 2004/0016540 | A1 | 1/2004 | Jarchau et al. |
| 2005/0115593 | A1 | 6/2005 | Publ |
| 2006/0037635 | A1 | 2/2006 | Rhodes |
| 2008/0035184 | A1 | 2/2008 | Wagner et al. |
| 2008/0210276 | A1 | 9/2008 | Porter et al. |
| 2011/0067736 | A1 | 3/2011 | Publ |
| 2012/0006363 | A1 | 1/2012 | Milojevic et al. |
| 2016/0001335 | A1 | 1/2016 | Forster |

FOREIGN PATENT DOCUMENTS

| | | | |
|---|---|---|---|
| EP | 2415532 | A1 | 2/2012 |
| EP | 2832879 | A1 | 2/2015 |
| EP | 2932879 | A1 | 10/2015 |
| JP | 2010274145 | A | 12/2010 |
| WO | 9620047 | A1 | 7/1996 |
| WO | 2004091817 | A1 | 10/2004 |
| WO | 2009134809 | A1 | 11/2009 |
| WO | 2017203357 | A1 | 11/2017 |

OTHER PUBLICATIONS

An Office Action issued by the Indian Patent Office dated Oct. 27, 2020 in connection with Indian patent application No. 201827046012.

A First Office Action issued by the Chinese Patent Office dated Dec. 14, 2020 in connection with Chinese patent application No. 201780031971.4.

An extended European search repod issued by the European patent office dated Dec. 6, 2019 in connection with European patent application No. 17879746.0.

An extended European search repod issued by the European patent office dated Dec. 6, 2019 in connection with European patent application No. 17802267.9.

International Search Report & Written Opinion issued by the International Searching Authority dated Sep. 26, 2017 in connection with international application No. PCT/IB2017/000714.

APPARATUS AND METHOD FOR CLEANING MACHINES

CROSS REFERENCE TO RELATED APPLICATIONS

This application is a continuation application of U.S. Nonprovisional application Ser. No. 15/600,505 filed on May 19, 2017, which claims priority to U.S. Provisional Application No. 62/340,286, filed on May 23, 2016, the disclosures each of which are hereby incorporated by reference in their entirety.

TECHNICAL FIELD

The present disclosure may relate to a cleaning apparatus which is used in industry for the purposes of cleaning large machine and motor parts, such as engine blocks. Related methods may also be described.

BACKGROUND

When repairing or reconditioning a machine, it may be required to clean parts of that machine. For instance, when reconditioning engines, engine parts may often be covered in grease, oil, and/or exhaust debris and thus may require cleaning to ensure the engine is able to operate as efficiently as possible once re-assembled. Generally, cleaning may be done in a chemical bath and/or in specially-designed cleaning equipment.

The use of a chemical bath, while effective, may take a long time to completely clean the part. Chemical baths may typically have a large volume of one or more chemicals contained in a vessel which is able to be agitated. The part to be cleaned may then be submerged in the chemical(s) and may sit in the bath for a significant amount of time in order to allow the chemical to clean the product. Chemical baths may be a very slow way of cleaning a part and also may present significant safety and environmental issues due to the nature of the chemical(s) (typically a caustic soda).

Cleaning equipment generally may comprise a housing having an opening at its upper face which is controlled by a closure. The interior of the housing may define a washing chamber which may accommodate a basket intended to receive machine parts and the like and which may be driven to rotate about its central axis within the housing. The washing chamber may be associated with a suitable spray system intended to direct a washing solution on to the parts being carried by the basket. Generally, the basket may be rotated while the spray system may remain fixed.

Cleaning equipment may be designed to suit particularly-sized parts. For example, a size of the housing, the design of the basket, and/or the associated spray system may be tailored to dimensions of parts the cleaning equipment may be used to clean. Current cleaning equipment may fall short for larger parts.

Due to size, cleaning equipment designed for large parts may lack portability and may take up a large area of floor space. The need for a large floor space may also be required to allow the part to be loaded into and unloaded from the cleaning equipment. Logically, in order to load and unload the part into the cleaning equipment, the opening of the cleaning equipment may need to be suitably sized. This opening may generally be closed by doors that may swing open and thus may need room to open and be positioned so as not to hinder the loading and unloading of the parts. This may increase the amount of floor space required to accommodate the cleaning equipment.

Due to the cleaning equipment's lack of portability, operators who need parts cleaned on a regular but perhaps not full-time basis may need to transport the parts to a location where there is suitable cleaning equipment. Alternatively, operators may rely on a process of cleaning which may be substandard. These delays in the repair/reconditioning of the part caused by the cleaning process may add considerable expense to the process.

Further, the position of the opening and the operation of the doors of cleaning equipment may make it difficult to load and unload a large part using an overhead crane. Such loading may require an operator to assist in manoeuvring the part into and out of the cleaning equipment, which may create an unsafe work environment.

As machinery, such as trucks and trains, become larger and more powerful, their engines and other parts may also increase in size and weight. For instance, an engine block of a V12 or V16 locomotive engine may be too large to be cleaned in current cleaning equipment. Due to the weight and shape of these parts, rotating baskets in available cleaning equipment may not readily support the load. Furthermore, the closure may make it very difficult to load and unload the part. Another difficulty may include the spray system of the cleaning equipment being unable to adequately clean the part's interior cavities.

Current cleaning techniques may not effectively clean parts of large size. In some attempts, a cleaning machine without a rotating basket may be utilized to clean the engine block, whereby the engine block may be placed vertically in the cleaning machine. However, and setting aside difficulties in loading and unloading the part, the engine part may be prone to distortion as a result of being in a vertical orientation for such a period of time. Furthermore, this method may not facilitate the cleaning of the cavities of the engine block.

In relation to chemical baths, the engine block may be required to sit in a bath for 2-3 days and may require at least 20000 liters of chemical, which may be prohibitively time consuming and expensive. Another option may be to manually clean the part. This method of cleaning not only may provide a substandard level of cleaning, but also may require a significant amount of time (e.g., at least 200 hours) as well as a large volume of solvent.

The preceding discussion of the background art may be intended to facilitate an understanding of the present disclosure only. The discussion may not be an acknowledgement or admission that any of the material referred to is or was part of the common general knowledge as at the priority date of the application.

SUMMARY

In one embodiment of the present disclosure, a cleaning apparatus may be described which may ameliorate, mitigate, and/or overcome at least one disadvantage of the prior art. At the very least, embodiments described herein may provide the public with a practical choice for cleaning large parts of machinery, particularly engines.

Throughout the specification the terms "part" and/or "parts" may be used to describe machinery and/or machinery parts and can include engine blocks.

The present disclosure may provide a cleaning apparatus for cleaning parts. The cleaning apparatus may comprise a housing defining a washing chamber. The washing chamber may have an opening through which parts may be loaded/ unloaded into the washing chamber. The cleaning apparatus may also comprise a support cradle adapted to support components to be cleaned. The support cradle may be located in the washing chamber. The cleaning apparatus may also comprise a spray system adapted to direct a washing solution to clean the part in the washing chamber. The cleaning apparatus may also comprise a closure which may provide controlled access to the washing chamber through the opening. The closure may be movable between a closed position to sealingly close the opening and an open position to allow for loading and unloading of parts into the washing chamber. When in an open position, the closure may be supported in a position away from the opening such that the closure does not provide an obstruction to the opening.

In contrast to the prior art, the closure may open in a manner which does not substantially increase the footprint of the cleaning apparatus. When in an open position, the closure may consume a minimum of plan area in the work space so as to not encroach upon the working space in front of or to the sides of the cleaning apparatus.

In some embodiments, the housing may comprise a frame having panels secured thereto. The opening may be located in a portion of the upper surface above the washing chamber. The opening may extend from the opening in the upper surface into a sidewall adjacent the washing chamber. Preferably the opening extends over a large portion of the upper surface and a large portion of the sidewall. Preferably the opening in the upper surface extends across the washing chamber. In this configuration the opening allows for loading and unloading through the upper surface of the housing and/or the side wall. As the opening extends from the upper surface into the sidewall, the part may be enabled to be moved/adjusted in a horizontal direction when unloading/loading.

The closure may comprise a lid comprising a first panel and a second panel. The first panel may be hingedly connected to the second panel. When the closure is in the closed position the first panel may be located over the opening in the sidewall, and the second panel may be located over the opening in the upper surface. Preferably, when the closure is in the open position, the lid may be in a collapsed configuration wherein the first panel and second panel are located side by side. The first panel may be received within the second panel. Preferably, when in the collapsed configuration, the first panel and second panel may be in a substantial vertical orientation. Preferably, when in the collapsed configuration, the first panel and the second panel may be positioned away from the opening such that they do not obstruct the opening when unloading/loading parts into the washing chamber. This may enable parts to be loaded/unloaded vertically, and may allow for easier positioning and maneuvering of parts when using cranes. Furthermore, as the movement of the lid is predominantly in the space above the footprint of the housing, the cleaning apparatus may be positioned in a smaller area when compared to prior art as there is no need to accommodate doors which swing open.

As the lid opens upwardly, the cleaning machine may not require as much floor space when compared to the prior art. This may be achieved without compromising an operator's requirement to access the washing chamber as the operator may access the washing chamber through the opening in the sidewall.

In some embodiments, the closure may comprise a linkage system which may move the lid between the open position and the closed position. The linkage system may be located outside the washing chamber. The linkage system may operatively engage each side of the lid. The linkage system may cause the first panel of the lid to rotate inwardly towards the second panel as the closure moves from the closed position to the open position. In some embodiments, the angle of the first panel relative to the second panel may remain fixed during a first stage of the closure moving towards the open position. The first stage may be defined by commencement of the movement of the closure from the closed position to the second position, and may terminate once the closure has moved sufficiently away from the housing such that the first panel may rotate towards the second panel without hitting the housing or the part to be cleaned.

In some embodiments, the linkage system may cause the lid to first move upwardly as the lid starts to move from the closed position to the open position. When the lid is in the closed position, the linkage system may be predominantly located within the housing but external to the washing chamber.

The linkage system may also comprise a plurality of linkage arms and an actuator at each end of the lid. The actuator may cause movement of the plurality of linkage arms in order to move the lid.

The support cradle may transfer loads thereon directly to the floor. As the loads are distributed directly to the floor, the housing of the cleaning apparatus may not need to be designed to support such a load. This may significantly reduce the weight of the housing. Additionally, the support cradle may be adjustable.

In an embodiment wherein the part to be washed is an engine block, the support cradle may support the engine block in a substantially horizontal orientation or at a small angle relative thereto. The small angle may be less than approximately 5 degrees. By supporting the engine block at a slight angle to its horizontal orientation, the washing solution may be better able to drain away.

The support cradle may also comprise a plurality of pedestals. Each of the pedestals may directly engage the engine block. The plurality of pedestals may be in the form of a first pair of pedestals and a second pair of pedestals. There may be additional pairs of pedestals as required. These variations are understood to be within the scope of the present disclosure.

The first pair of pedestals may include a projection extending upwardly therefrom such that upon loading the engine block into the washing chamber an end of the engine block is located relative to the projection and is supported upon the first pedestal. When the engine block is that of a v12 engine, the second pedestal may be positioned such that the other end of the engine block aligns with the second pair of pedestals. When the engine block is that of a v16 engine, the second pedestal may be positioned such that a portion of the engine block overhangs the second pedestal. The pedestals may support the engine block at the same position the engine is designed to be mounted when in use. The position of the engine block on the pedestal ensures the spray system is able to properly align with the engine block.

The top of the pedestals may comprise a support runner thereon. The support runners may provide a surface to assist in centering the block within the washing chamber. The support runners may be dimensioned such that the engine block, when supported thereon, is at a slight angle to the horizontal.

The washing chamber may include a plurality of guides to guide the part into the washing chamber and on to the support cradle as the part is being loaded into the washing chamber.

The spray system may comprise a plurality of spray arrays arranged to clean the part. Each spray array may provide a plurality of spray heads. In one aspect, the spray array may be in the form of a spray bar which supports the plurality of spray heads. The spray bar may rotate between a first angular position and a second angular position.

In another aspect, the spray array may move and oscillate a plurality of spray arms. Each spray arm may support the spray head at an end thereof. The spray head may rotate independently or in tandem with other spray heads. Each head may comprise three nozzles wherein each nozzle is orientated at different angles. Each spray arm may be individually controlled and adjusted. One or more spray arms in an array may be adjusted so as not to deliver any fluid to the part.

In another aspect of the present disclosure, the plurality of spray arrays may include a combination of the spray arrays as herein before described. The spray head may also deliver recycled water to the part. The recycled water may have particles therein up to approximately 3 mm in diameter. The particles in the washing solution and/or recycled water may include abrasives if helpful for the cleaning process.

In some embodiments, each spray head may comprise one or more brakes to slow down rotation of the head. This brake may be in the form of a magnetic brake. Slowing down the rotation of the spray head may result in better spray dwelling which may increase the efficiency of the cleaning process.

Further, each spray head and/or nozzle may be operated independently and/or positioned independently. For example, one or more spray heads and/or nozzles may be turned off to increase pressure to other spray heads and/or nozzles, depending on requirements of a particular cleaning operation.

One or more spray arrays may be configured to clean a cavity within the part. In some embodiments, the spray arrays may be configured to clean inner surfaces of the cavity. The one or more spray arrays may be configured to move the spray arms from a non-spray position, to a first spray position wherein at least the head of each spray arm is located at a first position within the cavity. The one or more spray arrays may be configured to move the spray arms to a second spray position wherein at least the head of each spray arm is located at a second position within the cavity. The cavity may comprise a first cavity portion wherein the first position lies, and a second cavity portion wherein the second position lies. The spray system may configure the spray arms at further positions within the cavity as may be required. These variations are understood to be within the scope of the present disclosure.

One or more further spray arrays may be configured to move the spray heads at multiple positions relative to an opening of a recess or a cavity such that head is able to direct washing solution to all internal surfaces of the recess/cavity. The one or more further spray arrays may be mounted in the lid.

The spray system may be pneumatically operated whereupon lack of pressure results in the spray system returning to a non-spray, retracted position. In the retracted position the spray arrays are positioned such that the part may be loaded/unloaded into the washing chamber. Each spray array of the spray system may comprise a plurality of bumpers which may be adapted to protect the spray array as well as the part should the spray array engage the part.

The spray system may also comprise one or more actuators to operate the spray arrays. The actuators may actuate the spray arrays in a manner whereby, should a part of the spray array engage the part, the actuator may not exert excessive force thereon. In this regard the actuators may balance the movement of the spray array with that of engaging an obstacle. This may not only protect the part but also may minimize the risk of breaking a spray arm and/or spray array. Additionally, the spray arms may be removed, replaced, and/or repositioned. This may allow a spray array to be tailored to clean different parts, such as differently-sized engine blocks.

In some embodiments, the cleaning apparatus may further comprise a fluid supply system. The fluid supply system may comprise a filtration system for treating the washing solution and a reservoir for holding the washing solution. The filtration system may treat the washing solution so that it may be recycled and be fed to the spray arrays multiple times during a wash cycle. The filtration system may comprise at least one screen, a settling reservoir/overflow region, and/or a flotation reservoir/underflow region. The filtration system may also comprise an outlet wherein the outlet is located to draw fluid from a mid-point (e.g., a height) from the filtration system. The outlet may be in fluid communication with the reservoir.

The filtration system may be in the form of a tray which moves from an in-use position to an extended position wherein the tray may be serviced by an operator. As the tray slides out of the housing the operator may not be required to enter the housing in order to clean and service the filtration system.

In some embodiments, the reservoir may store the washing solution and/or may provide a heating unit to heat the fluid for cleaning. The reservoir may have a flow control device connected to an external supply. The flow control device may deliver fluid to the reservoir in order to fill the reservoir prior to and/or during a cleaning cycle.

The fluid supply system may also comprise a pump for circulating fluid through the spray system. The pump may be located within the housing but external to the washing chamber, or in another location. For example, the pump may be slidably received in the housing for ease of servicing.

Again, the present disclosure may provide a cleaning apparatus for cleaning parts. The cleaning apparatus may comprise a housing defining a washing chamber. The washing chamber may have an opening through which parts may be loaded/unloaded into and out of the washing chamber. The cleaning apparatus may also comprise a support cradle adapted to support components to be cleaned. The support cradle may be located in the washing chamber. The cleaning apparatus may also comprise a spray system adapted to direct a washing solution to clean the part in the washing chamber. The cleaning apparatus may also comprise a fluid supply system comprising a filtration system and a reservoir wherein the filtration system treats the washing solution before it passes into the reservoir. The treated washing solution may be reused in the spray system. The cleaning apparatus may also comprise a closure which provides controlled access to the washing chamber through the opening. The closure may be movable between a closed position to sealingly close the opening, and an open position to allow for loading and unloading of parts into and out of the washing chamber. When in an open position, the closure may be supported in a position away from the opening such that the closure does not provide an obstruction to the opening.

BRIEF DESCRIPTION OF THE DRAWINGS

Further features of the present disclosure may be more fully described in the following description of several nonlimiting embodiments thereof. This description may be included solely for the purposes of exemplifying the present disclosure. It may not be understood as a restriction on the broad summary, disclosure, and/or description of the disclosure as set out above. The description may be made with reference to the accompanying drawings.

In the drawings like structures are referred to by like numerals throughout the several views. The drawings shown are not necessarily to scale, with emphasis instead generally being placed upon illustrating the principles of the present disclosure.

DESCRIPTION OF EMBODIMENTS

The present disclosure may be suited to clean large machines and machine parts and obviates the need to manually clean the part, or to use expensive and dangerous chemical baths. While other specialized cleaning equipment may be available for cleaning machine parts, these may all be based on rotation of a basket for effective cleaning. Large, heavy parts may not be cleaned in this type of equipment as the part would be too heavy to be accommodated by a rotating basket.

FIGS. 1 to 14 may show a cleaning apparatus 11 according to a first embodiment of the present disclosure. In this embodiment, the cleaning apparatus 11 may be particularly suited to clean a part in the form of an engine block 13 from a V12 or V16 engine. It may be noted that the cleaning apparatus 11 of the present disclosure may be designed to clean other large parts and that such a design is considered to be within the scope of the present disclosure. To date there may be no comparable cleaning option to clean this size of part when considering the cleaning apparatuses of the prior art.

As shown in FIGS. 1-6, the cleaning apparatus 11 may comprise a housing 15. In this embodiment, the housing 15 may be similar in dimensions to a sea/shipping container. This may enable the cleaning apparatus 11 to be readily stored and transported using standard equipment. The housing 15 may house substantially all components of the cleaning apparatus 11. The housing may comprise a frame 17 to which panels (not shown) may be secured. The frame 17 and associated panels may provide the required strength and rigidity to enable the cleaning apparatus 11 to be transported.

Figure 1:
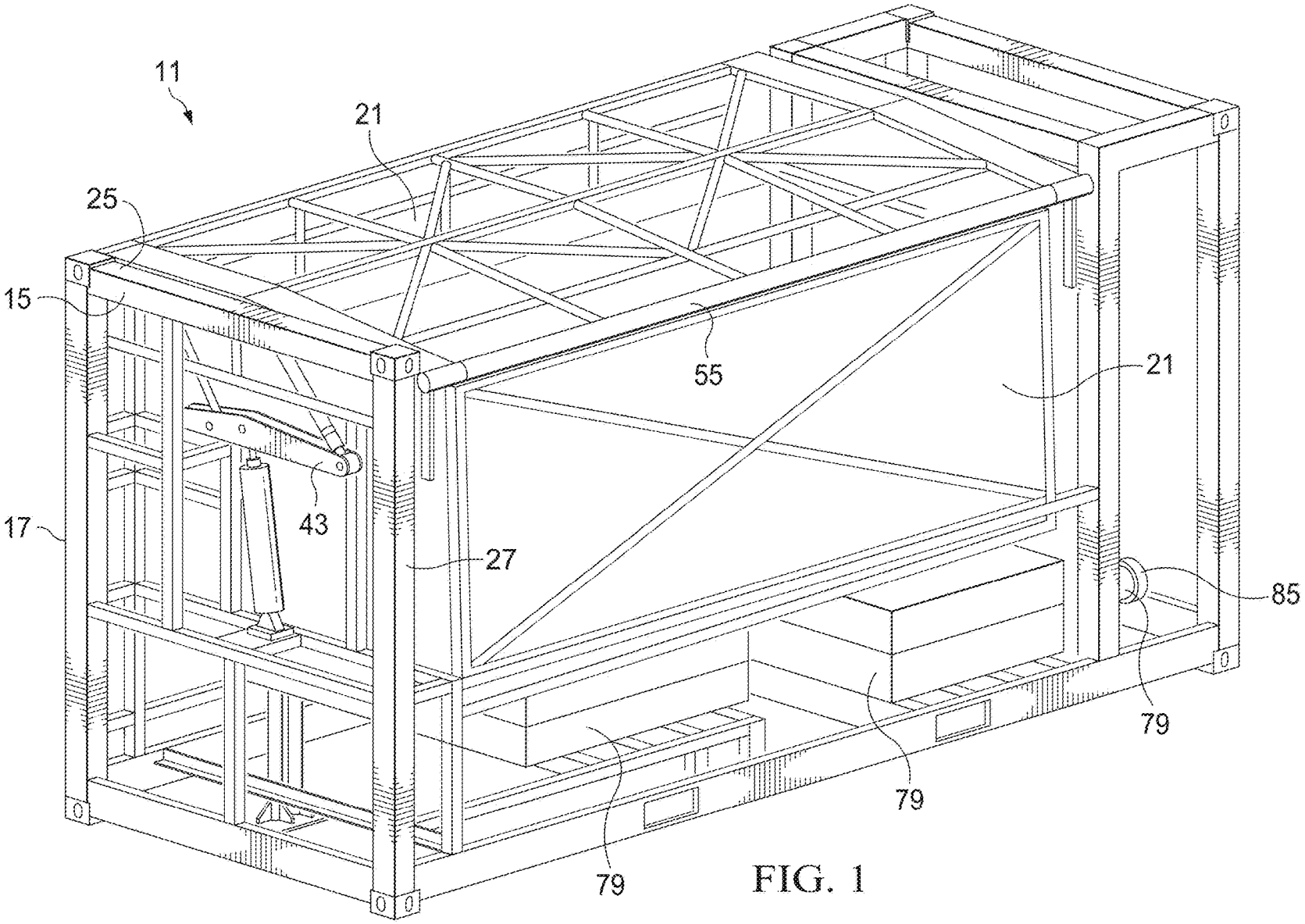
FIG. 1 is a front perspective view of a cleaning apparatus according to an embodiment of the present disclosure, the cleaning apparatus is shown without panels and with a closure in a first position.
Figure 2:
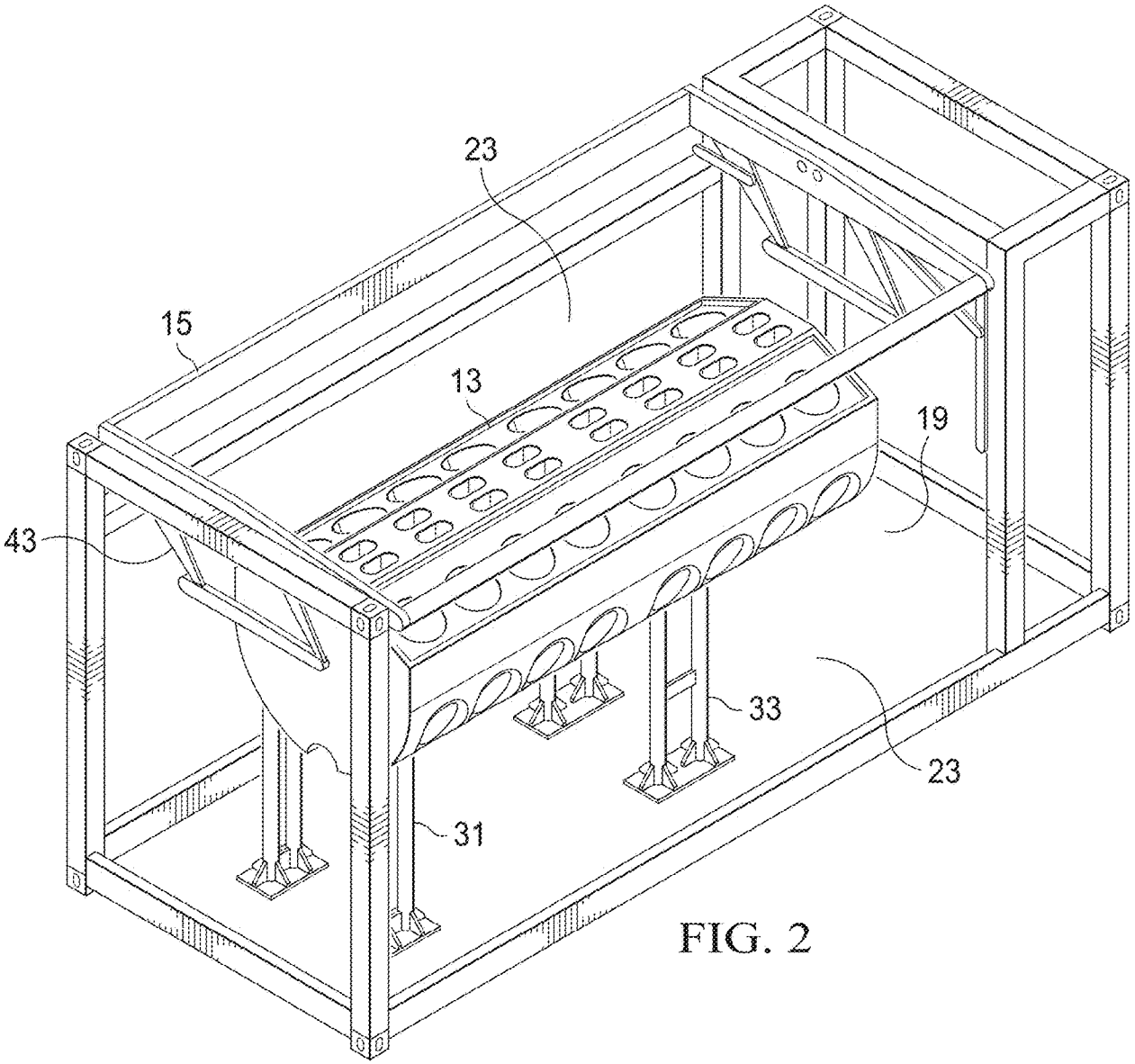
FIG. 2 is a front perspective view of the cleaning apparatus shown in FIG. 1 with an engine block located therein, the cleaning apparatus is schematically represented without panels and a lid of the closure.

As shown in FIG. 2, a washing chamber 19 may be defined within an interior of the housing 15. The washing chamber 19 may receive the engine block 13 and may provide a substantially sealed chamber during a washing cycle to contain washing solution within the housing 15.

The cleaning apparatus 11 may further comprise a closure 21 for closing an opening 23 in the housing 15. The opening 23 may be sufficient in size to allow for unobstructed loading and unloading of the engine block 13 into/from the washing chamber. The opening 23 may be defined in a portion of an upper surface 25 of the housing 15 and may extend down an adjoining sidewall 27. As noted in FIGS. 1 and 2, the frame 17 may not extend across a front upper edge of the washing chamber 19 as this may cut across the opening 23.

Figure 3:
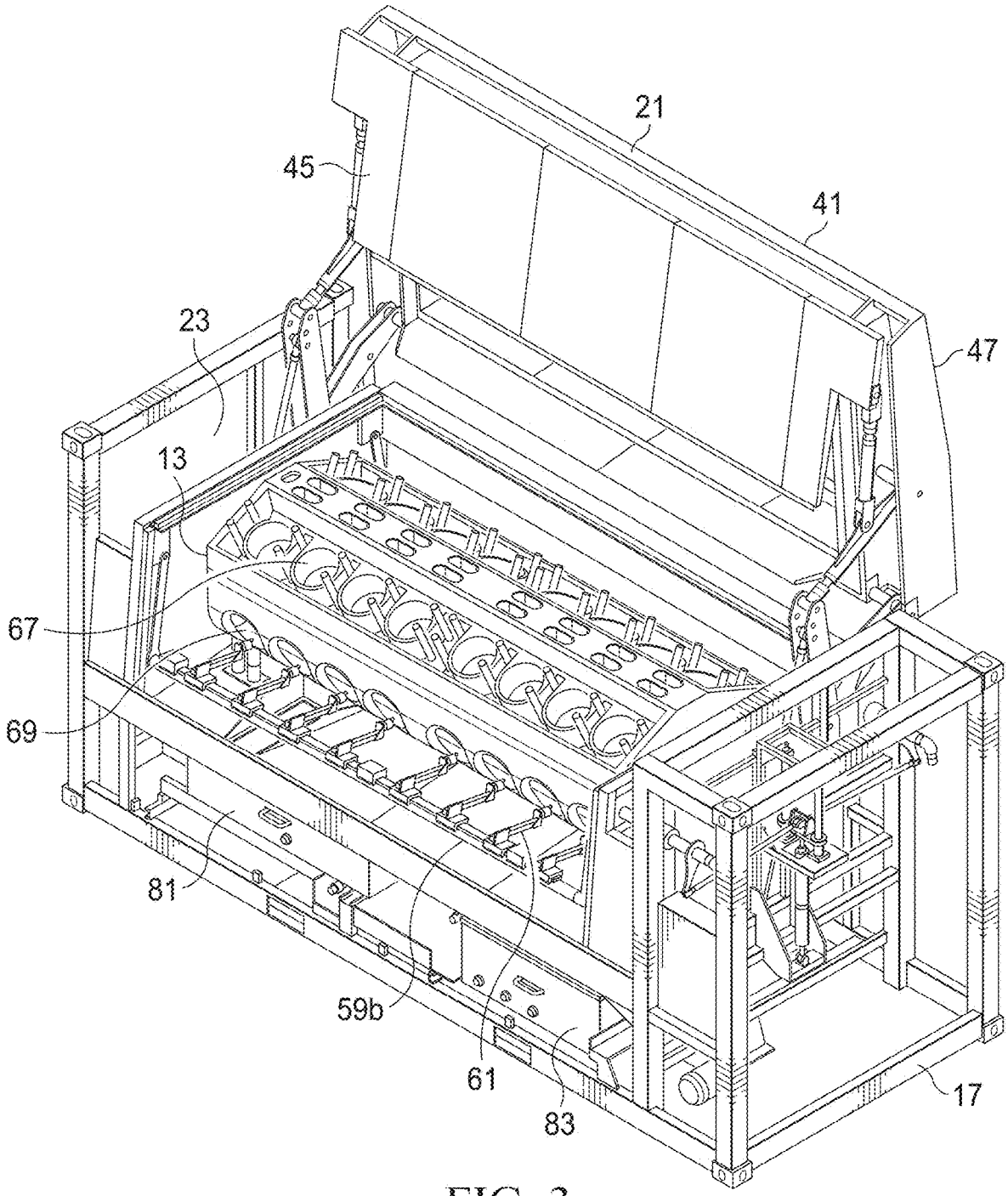
FIG. 3 is a front perspective view of the cleaning apparatus shown in FIG. 1 having the closure in an open position and having an engine block located therein.

FIG. 3 shows that the opening 23 in the upper surface 25 may be located directly above the washing chamber 19. This positioning may enable the engine block 13 to be loaded vertically (e.g., from above) into the washing chamber 19 using a crane (not shown). This also may allow the engine block 13 to be lowered from above and into the washing chamber 19 in a generally horizontal orientation ready for cleaning, thereby negating the need to maneuver the engine block 13 within the washing chamber 19 before it can be cleaned. Additionally, as the sidewall 27 may also provide part of the opening 23, the engine block 13 may be freely moved in/loaded from a lateral direction, such as may be required when using a forklift.

Figure 4:
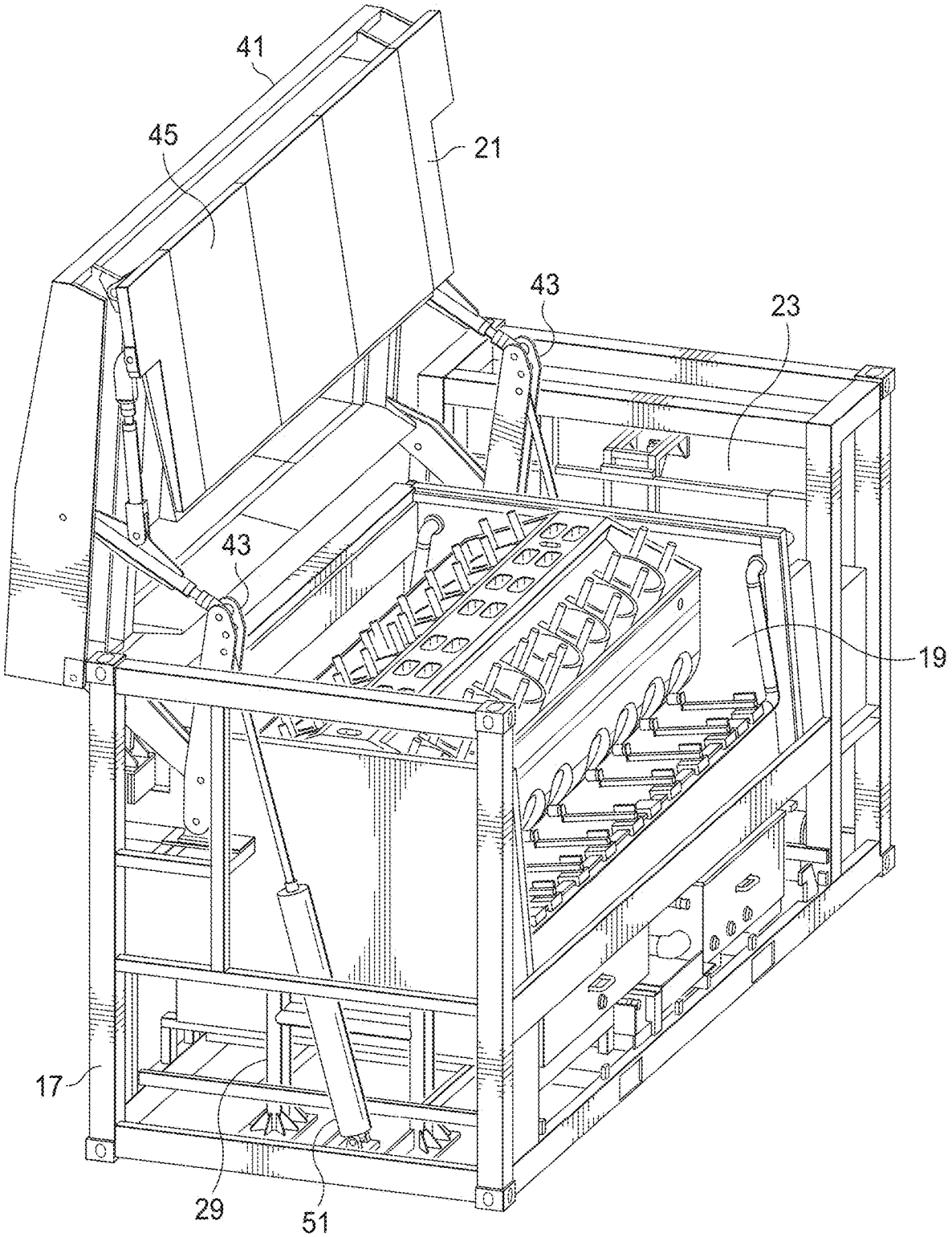
FIG. 4 is an end perspective view of FIG. 3.
Figure 5:
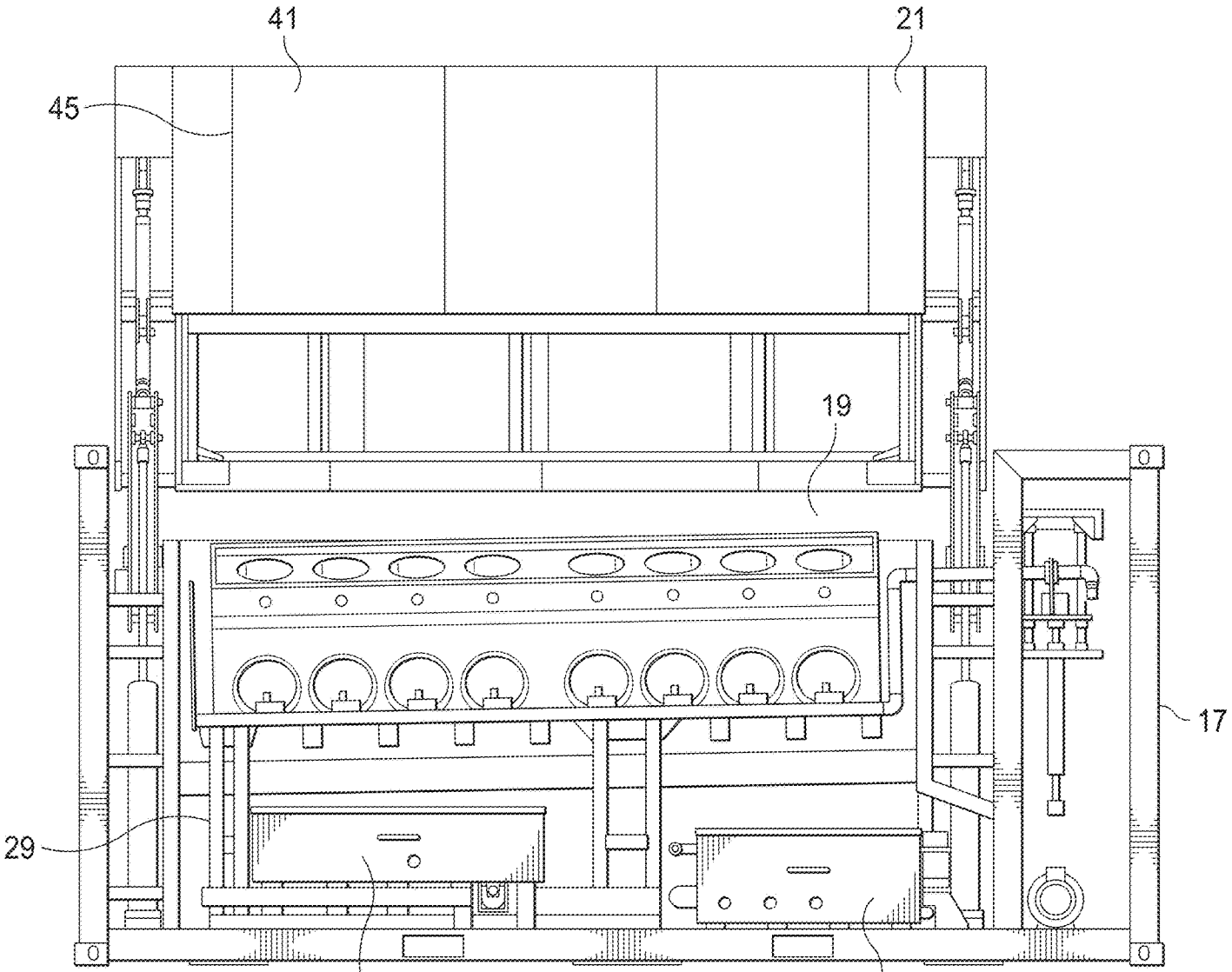
FIG. 5 is a front view of FIG. 3.
Figure 6:
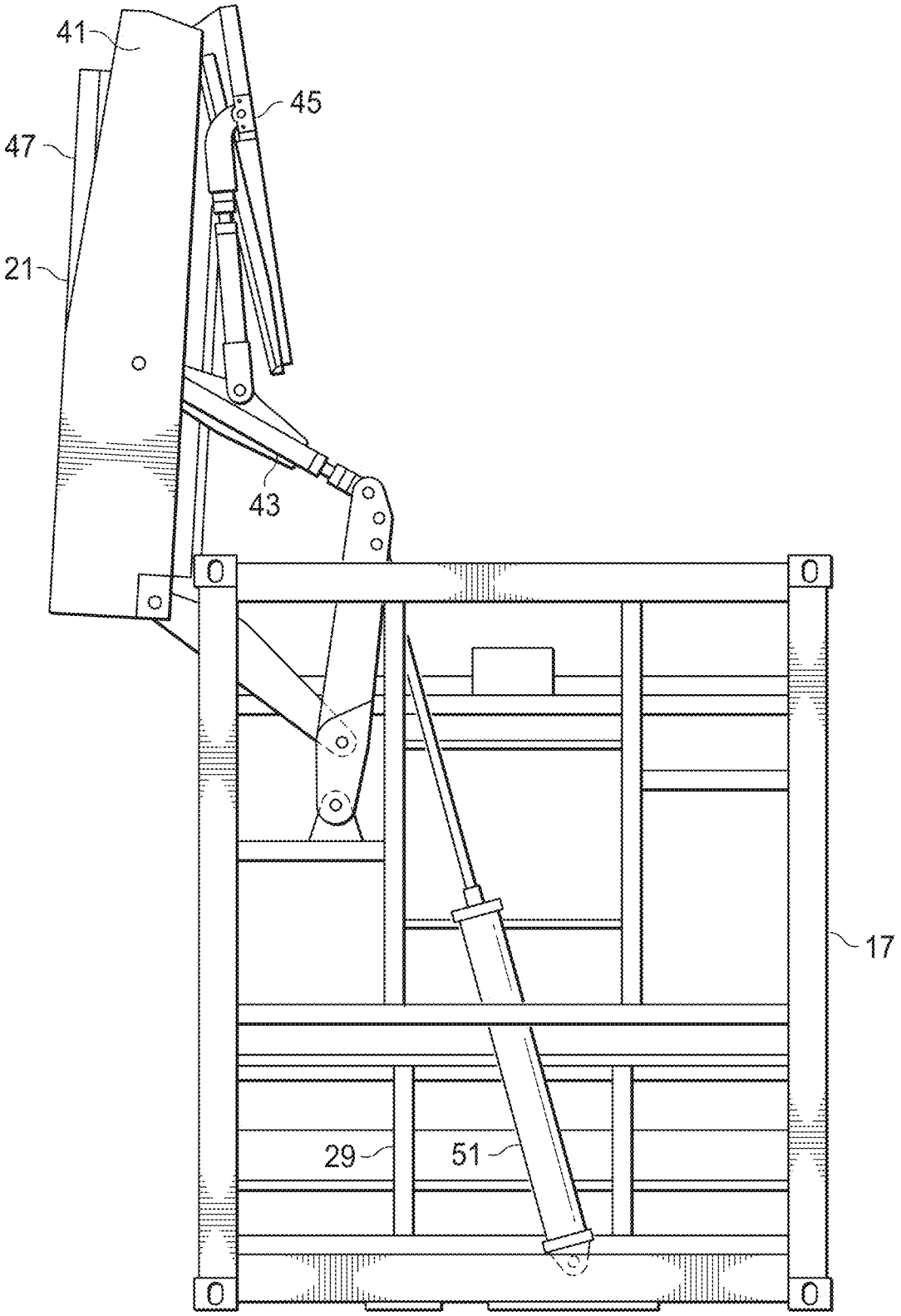
FIG. 6 is a side view of FIG. 3.

As shown in FIGS. 4-6, the cleaning apparatus 11 may also comprise a support cradle 29 for supporting the engine block 13 when positioned within the washing chamber 19. While the support cradle 29 may be secured relative to the housing 15, the support cradle 29 may be configured such that the load experienced by the support cradle 29, including any shock load as may occur when loading an engine block 13 thereon, may be distributed through the floor upon which the cleaning apparatus 11 sits. As a result, the cleaning apparatus 11 may not need to be engineered to take the load of the engine block 13, allowing the housing 15 to be made from less material, reducing cost and weight. The floor may have additional footings poured where the cleaning apparatus 11 may be positioned to assist in distributing the load within the floor.

Figure 8:
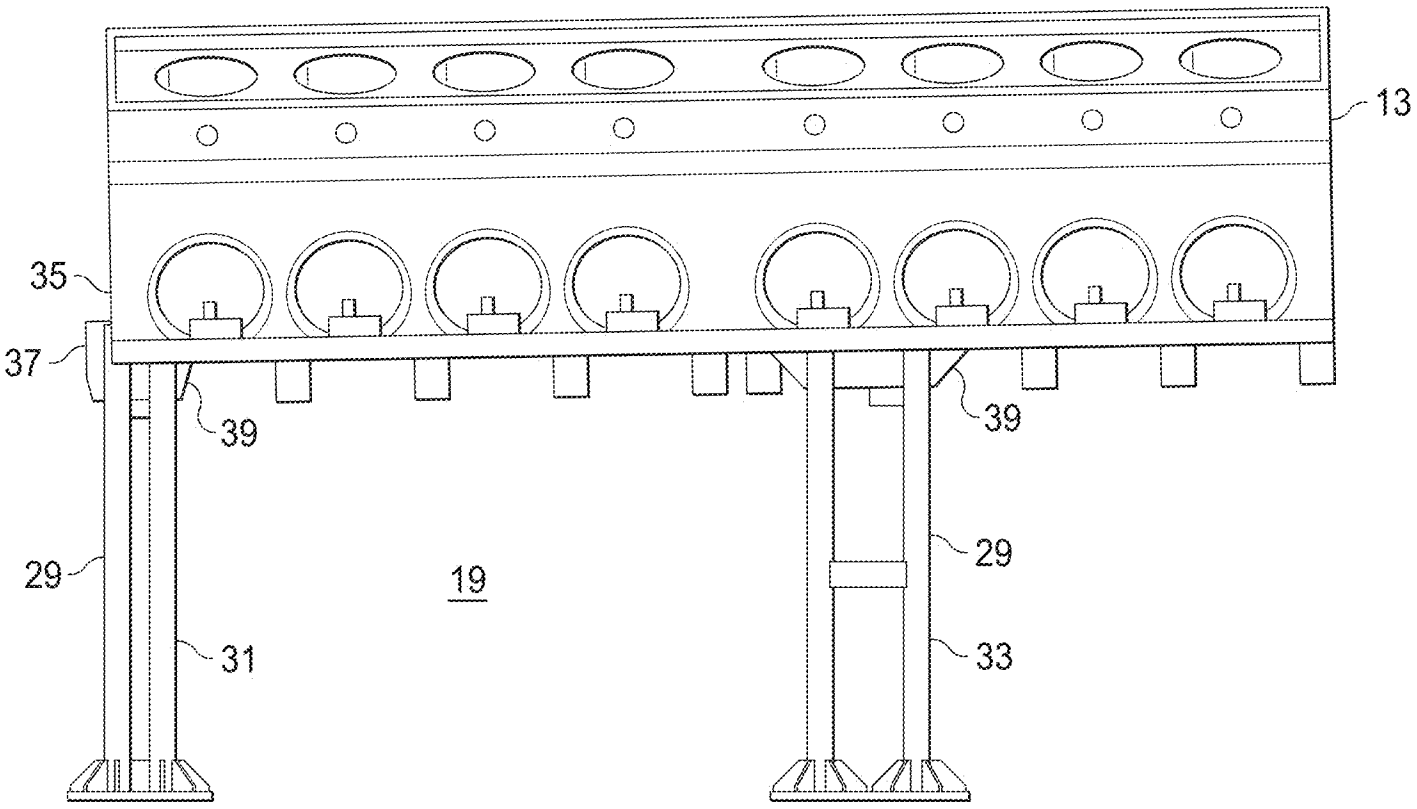
FIG. 8 is a side view of a part of the engine block supported on a support cradle of the cleaning apparatus of FIG. 1.

As shown in FIG. 8, the support cradle 29 may comprise two (or multiple) pair of pedestals 31, 33. Each pair of pedestals 31, 33 may be located relative to the washing chamber 19 such that the engine block 13 may be supported on its safest, flat load bearing surface. The first pair of pedestals 31 may be designed to receive a first end 35 of the engine block 13. To assist in locating the engine block 13 thereon, the first pair of pedestals 31 may have an upwardly extending projection 37. As the engine block 13 is being lowered into the washing chamber 19, the first end 35 of the engine block 13 may abut the projection 37 so as to locate the engine block 13 relative to the support cradle 29.

The second pair of pedestals 33 of the support cradle 29 may support the engine block 13 such that the center of gravity of the engine block 13 is located between the two pair of pedestals 31, 33. When the cleaning apparatus 11 is configured to clean an engine block for a V12 engine, for example, the second pair of pedestals 33 may be located at a second end of the engine block 13.

Each pair of pedestals 31, 33 may have a support runner 39 along the top. The support runners 39 may be configured to centrally locate the engine block 13 relative to its longitudinal axis. The support runners 39 may each be formed from steel and may have a plastic strip thereon for protecting the engine block 13. The plastic may have high impact resistant characteristics (e.g., Polytetrafluoroethylene (PTFE) and/or Polyoxymethylene (POM)). The support runners 39 may have different thicknesses such that when the engine block 13 is supported thereon, the engine block 13 may be angled relative to the horizon by approximately 1 degree. This may assist in drainage of the washing solution, preventing pooling within the engine block 13.

Once the engine block 13 is loaded in the washing chamber 19, the opening 23 may be closed by the closure 21. As shown in FIGS. 3-7, the closure 21 may comprise a lid 41, which may be movable from a closed position to an open position by a linkage system 43 (and vice versa).

Figure 7:
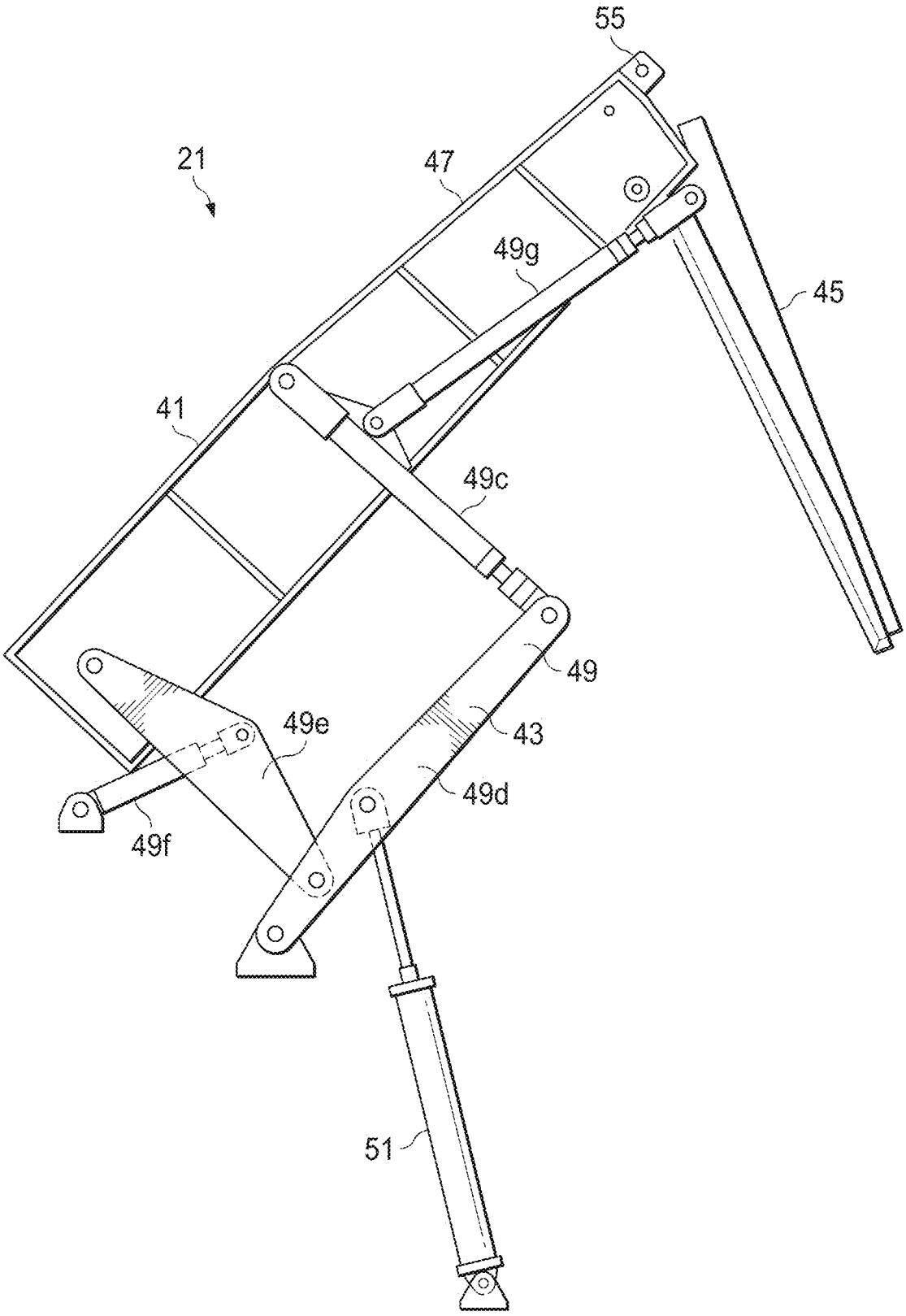
FIG. 7 is a side view of the closure shown in FIG. 1, the closure is located in an intermediary position between an open position and a closed position.

As seen in FIGS. 3, 4, and 7, the lid 41 may comprise a first panel 45 which is hingedly connected to a second panel 47. When the closure 21 is in the closed position, the first panel 45 may close the portion of the opening 23 in the sidewall 27 of the housing 15, while the second panel 47 may close the portion of the opening 23 in the upper surface 25.

When the closure 21 is in the open position as seen in FIGS. 3-6, the first panel 45 and the second panel 47 may be in a vertical orientation in a side by side relationship. When in this position, the lid 41 may be in a collapsed arrangement above the housing 15 and may be spaced away from the opening 23. In this arrangement, the lid 41 may not encumber the loading and unloading of the engine block 13 relative to the washing chamber 19. Furthermore, as the open lid 41 is in the space above the housing 15, the footprint of the cleaning apparatus 11 may be minimized as it does not have doors which open outwardly from the side of the housing 15. Furthermore, as the opening 23 also extends along the sidewall 27, operators may be readily able to access the washing chamber 19 to inspect the engine block 13 and to conduct maintenance on the washing chamber 19.

When the lid 41 is in the closed position, the linkage system 43 may be located within the housing 15 yet external to the washing chamber 19. As shown in FIGS. 3-7, the linkage system 43 may comprise a set of linkage arms 49 located at opposed ends of the lid 41. Each set of linkage arms 49 may be operatively connected to an actuator 51 for movement of the lid 41 between the open position and the closed position. The actuator 51 may cause movement of the plurality of linkage arms 49 in order to move the lid 41. In the event the cleaning apparatus 11 malfunctions or fails, the actuator 51 may cease movement and may hold the lid 41 in the position it was in when the cleaning apparatus malfunctioned.

As seen in FIG. 7, each set of linkage arms 49 may comprise linkage arms 49*c*, 49*d* and 49*e*. These may operate within the confines of the housing 15 and eliminate the need for pivot points extending outside the housing 15.

In the initial stage of moving the lid 41 from the closed position to the open position, linkage arm 49*d* may cause the lid 41 to first move in an upward direction away from the opening 23. As the lid 41 approaches the open position, linkage arm 49*f* may cause the lid 41 to be held in a vertical orientation rearwardly from the opening 23 as seen in FIGS. 3-6.

As the lid moves from the closed position to the open position, the first panel 45 may be caused to move towards the second panel 47. Linkage arm 49*g* may cause the first panel to rotate about an axis extending along an edge portion 55 where the first panel 45 is connected to the second panel 47. However, linkage arm 49*g* may only cause the first panel 45 to rotate inwardly towards the second panel 47 once the first panel 45 is sufficiently clear of the housing 15. This may ensure that the lid 41 is able to freely collapse as it moves to the open position without hitting the housing 15 (see FIG. 6).

In some embodiments, the washing chamber 19 may comprise a series of guards (not shown) located around the opening 23. The guards may protect seals (not pictured) located between the lid 41 and the opening 23 to minimize the risk of washing solution leaking from the housing 15 during operation.

Figure 9:
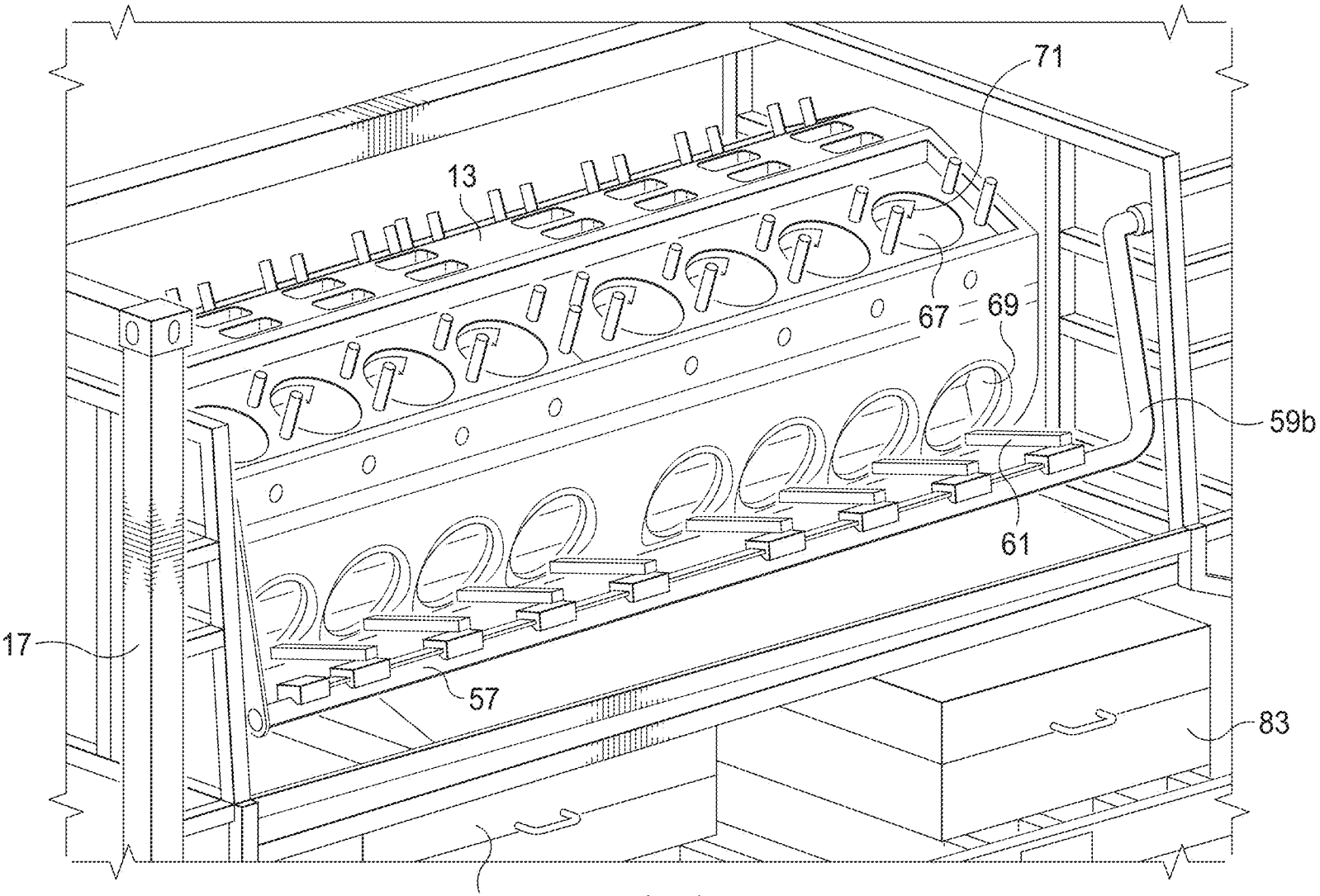
FIG. 9 is a side perspective view of a spray system of the cleaning apparatus shown in FIG. 1 with an engine block located therein.

Referring now to FIG. 9, the cleaning apparatus 11 may additionally include a spray system 57 which sprays a washing solution onto the engine block 13 during cleaning operations. A spray array 59 (e.g., spray array 59*a*, spray array 59*b*) may be supported on an underside of the second panel 47 of the lid 41 and move with the lid 41. This may ensure the spray arrays 59*a* do not affect the loading and unloading of the engine block 13.

The engine block 13 may include two main regions which require cleaning. These two regions may each require a differently configured spray array to provide adequate cleaning. One region may be the top of the engine block 13 which has a first set of cavities 67 and surfaces defined in the upper portion of the engine block 13. This first region provides the valve train sections. The second region may incorporate a second set of cavities 69 defined in the lower portion of the engine block 13.

The spray system 57 of the present embodiment may comprise a number of spray arrays 59 (e.g., spray arrays 59*a* of FIG. 10, 59*b* of FIGS. 3 and 9-11) that corresponds to a number of cavities 67, 69 of the engine block. For example, in a V12 engine, the spray system 57 may include six spray arrays 59. Of these six spray arrays 59, four spray arrays 59*a* may be configured to clean the upper region of the engine block 13 including the cavities in the top of the engine block 13 (e.g., cavities 67), while the remaining two spray arrays 59*b* may be configured to clean cavities in either side of the engine block 13 (e.g., cavities 69). Each spray array 59 comprises a plurality of spray heads 63 (e.g., spray heads 63*a* and 63*b*) as seen in FIGS. 3, 4, and 9-12 and as described in more detail with reference to FIGS. 18-21.

As the engine block 13 may be relatively symmetrical, the below disclosure relates to cleaning operations performed to one side of the engine block 13 only. However, it is to be understood that a similar configuration may apply to the other side of the engine block 13.

Figure 10:
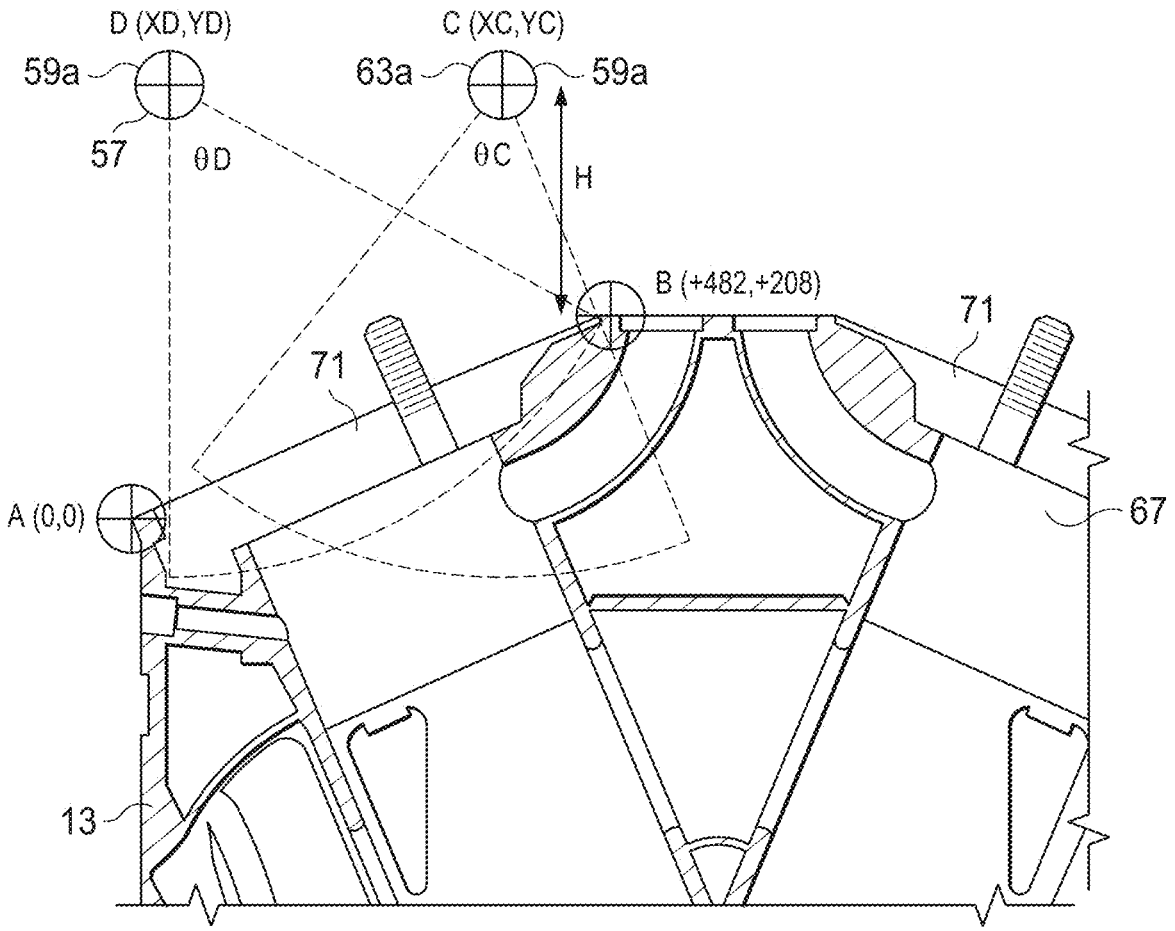
FIG. 10 is a cross sectional view of the spray system relative to a first cavity of and surrounding surfaces of the top of the engine block.

Consider a cavity 67*a* of the first set of cavities 67 located in the top of the engine block 13 as shown in FIG. 10. In order to clean the inner surface of the cavity 67*a*, spray may be delivered relative to a cavity opening 71 from different locations/angles. To efficiently achieve this result, the spray system 57 may allocate two spray arrays 59*a* to the first set of cavities 67, and each spray array 59*a* may provide a spray head 63 to a corresponding cavity 67*a*. During a cleaning cycle, two spray heads 63*a* may be positioned relative to each cavity opening 71 so as to be directed toward the cavity 67*a* in an angular spaced relation to each other.

To also clean the surfaces surrounding each cavity 67*a*, as well as to improve the cleaning action of the spray heads 63*a*, each spray array 59*a* may comprise a rotating spray bar (e.g., spray arm 61 and/or another element) upon which the spray heads 63*a* may be mounted. The spray bar may be able to rotate approximately 55 degrees about its central axis causing a line of spray from the spray head 63*a* to sweep both an inner surface of the cavity 67*a* and surrounding surfaces.

Figure 12:
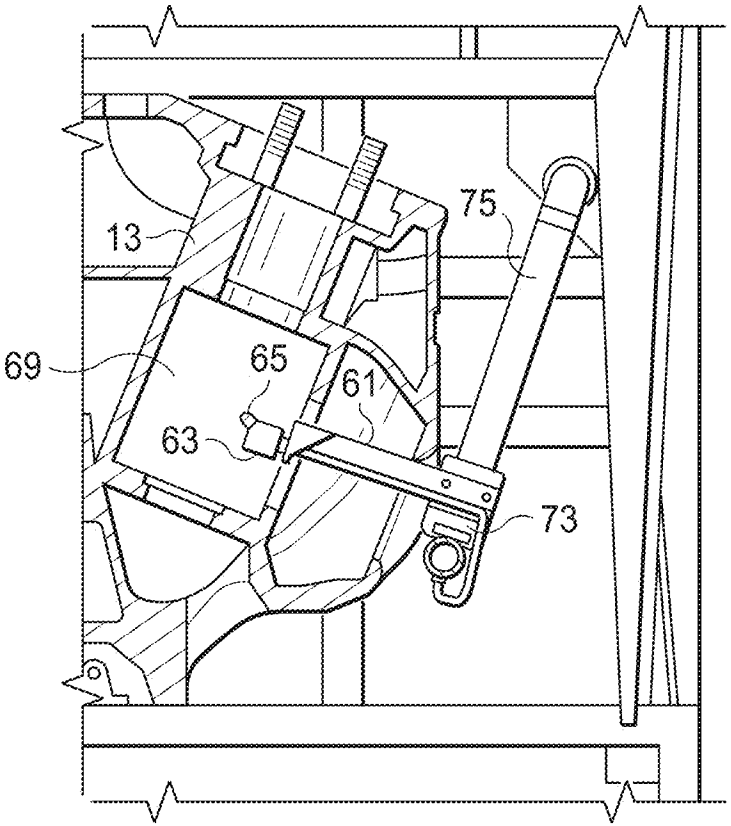
FIG. 12 is a cross sectional view of the spray system relative to a second cavity of the engine block.
Figure 11:
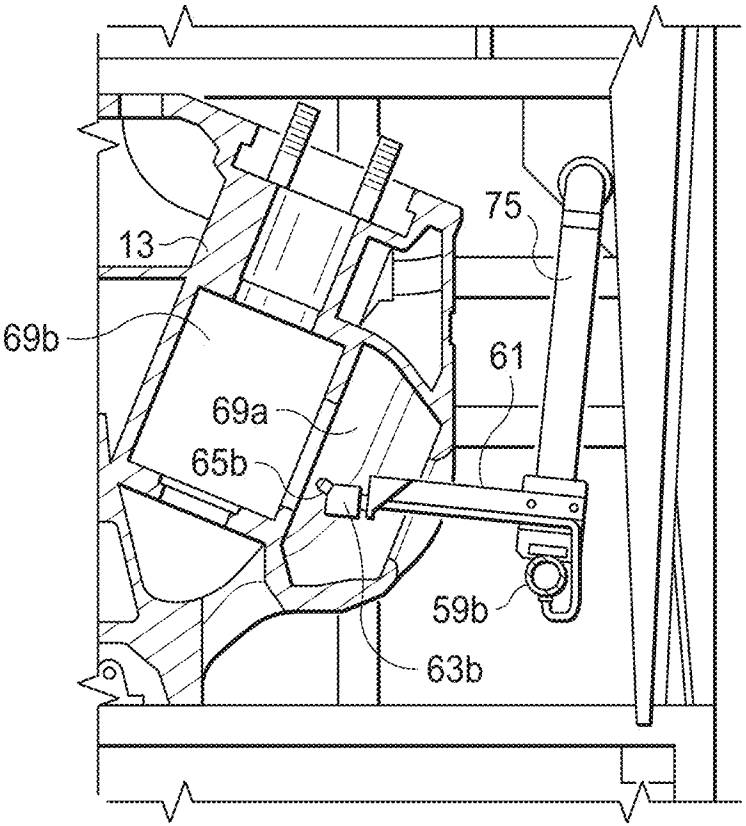
FIG. 11 is a cross sectional view of the spray system relative to a second cavity of the engine block.

Consider a cavity 69*a* of the second set of cavities 69 located in the side of the engine block 13. As shown in FIGS. 11 and 12, cavity 69*a* may comprise two distinct sub-cavities and spray array 59*b* may be configured to clean the inner surface of each of the sub-cavities.

Spray array 59*b* may comprise eight spray arms 61, each having a spray head 63*b* at an end thereof. Each spray arm 61 of the spray array 59*b* may be adapted to position the spray head 63*b* in the cavity 69*a* at a first position and a second position, the first position being located within one of the sub-cavities (FIG. 11) and the second position being located within the other sub-cavity (FIG. 12). With this arrangement the spray head 63*b* may clean the entire inner surface of the cavity 69*a*.

During the cleaning cycle of the cavity 69*a*, a portion of one of the spray arms 61 may enter the cavity 69*a* to locate the spray head 63*b* at the first position. In this position, the spray head 63*b* may be able to clean the first sub-cavity of the cavity 69*a*. Once this is complete, the spray array 59*b* may cause the spray arm 61 to move further within the cavity 69*a* such that the spray head 63*b* may be located at the second position. In this position, the spray head 63*b* may be able to clean the second sub-cavity of the cavity 69*a*.

In some embodiments, and as shown in FIGS. 18-21, the spray head 63 of the spray array 59 may be a rotating spray head and may comprise three nozzles 65 angularly orientated with respect to each other. The spray head 63 may include flat spray nozzles 65. Each spray head 63 may comprise a magnetic brake 66 therein for slowing down the rotation of the spray head 63 and/or each individual nozzle 65. This may increase the efficiency of the cleaning process as the spray has a longer dwell. In some embodiments, each spray head 63 and/or each individual nozzle 65 may be independently rotatable.

During operation, the spray arrays 59 may be movable from a retracted position, wherein the engine block 13 may be loaded/unloaded from the washing chamber 19, to a cleaning position for cleaning the engine block 13. Additionally, each spray array 59 may be pneumatically controlled using an actuator mechanism 75 whereupon malfunction of the cleaning apparatus 11 may cause the spray array 59 to return to its retracted position. Each spray arm 61 may also be fitted with a bumper 73, which may minimize damage of the engine block 13 and the spray arm 61 should the spray array 59*b* cause the spray arm 61 to engage the engine block 13 (or another rigid obstacle).

In some embodiments, each spray array 59 may comprise eight spray heads 63. When the engine block 13 is from a V12 engine, only six spray heads may be required on each spray array 59. When this is the case, any spray heads 63 not required may be removed from the spray array 13 and the associated hole in the spray array 59 may be plugged.

The cleaning apparatus 11 may also comprise a fluid supply system 79. Shown in FIGS. 1, 3, 5, 9, and 13-14, the fluid supply system 79 may comprise a filtration system 81 for treating washing solution, a reservoir 83 for holding washing solution, and/or a pump 85 for circulating washing solution through the cleaning apparatus 11.

Figure 13:
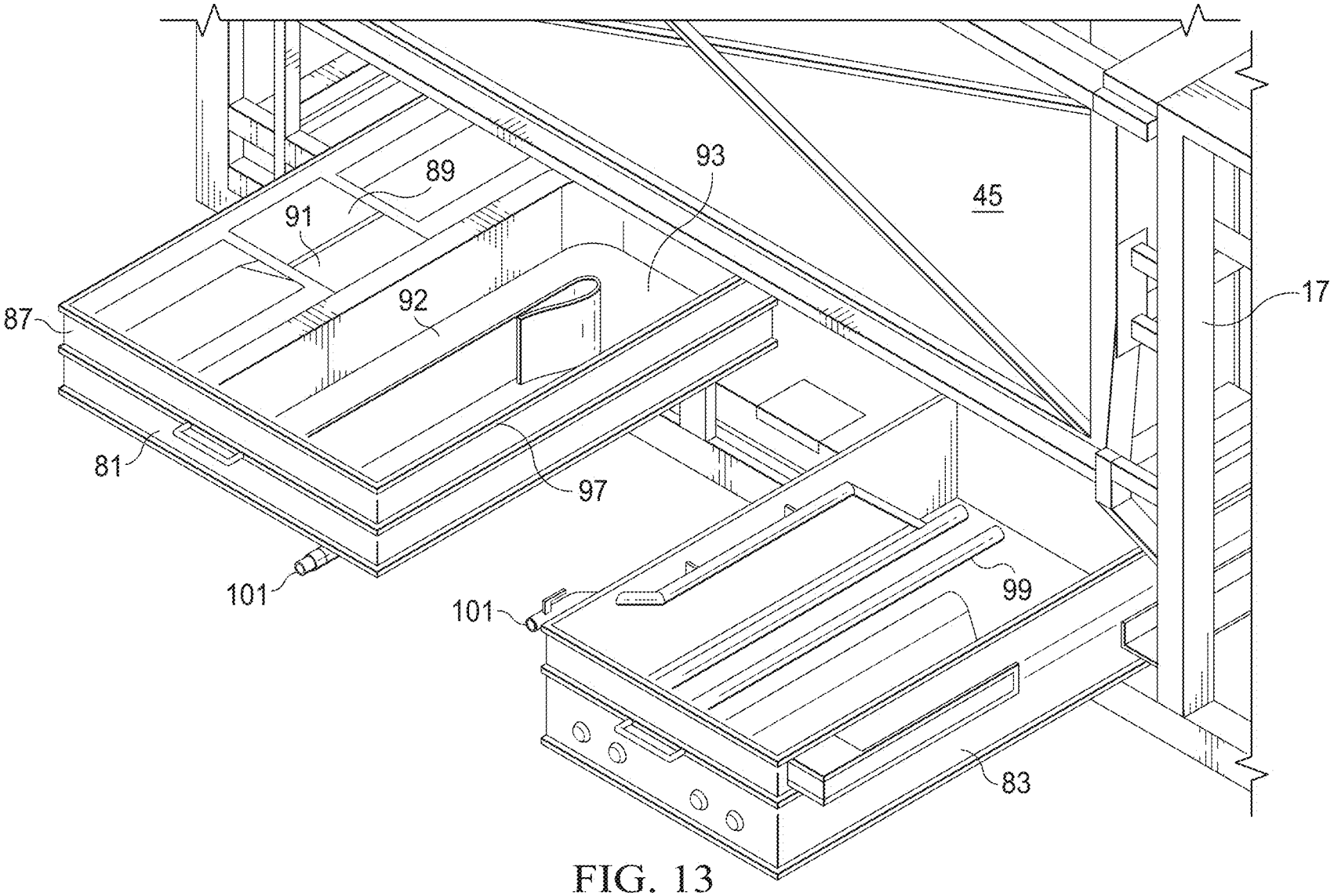
FIG. 13 is a front perspective view of a filtration system of the cleaning apparatus shown in FIG. 1 wherein the filtration system is in an open condition.
Figure 14:
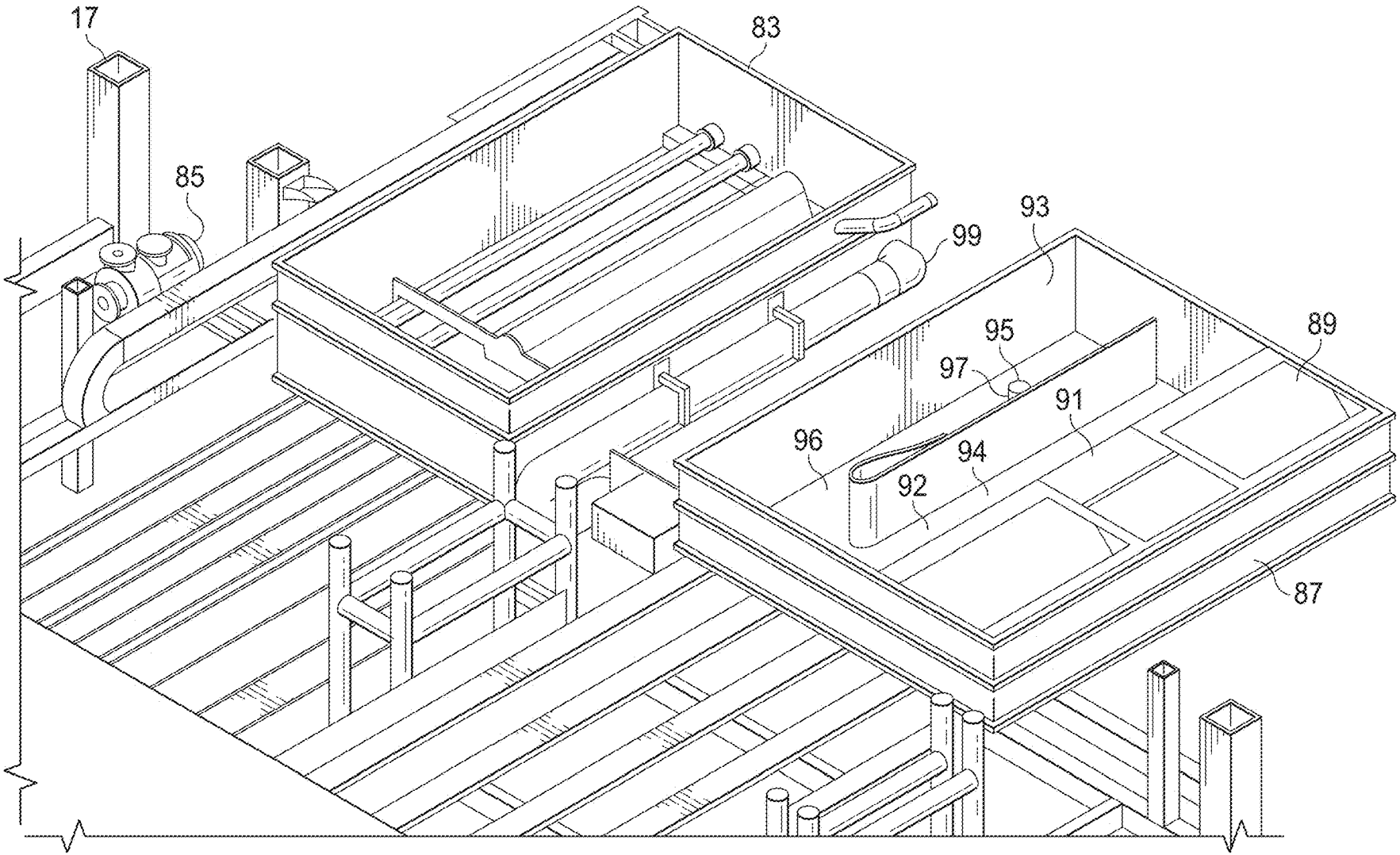
FIG. 14 is a rear perspective view of FIG. 13.

As seen in FIGS. 13 and 14, the filtration system 81 may be in the form of a filtration tank 87 which may be slidably received in the housing 15 such that it may be positioned under the washing chamber 19. The filtration system 81 may include a screen (not shown) to first filter the washing solution as it leaves the washing chamber 19. The washing solution then may enter an overflow region 89 of the filtration tank 87 where heavy particles may settle to the bottom. When the fluid level in the overflow region 89 reaches the height of a weir wall 91, the liquid may spill over into the underflow region 93. This region may allow the separation of oils and other particles which float to the top.

Shown in FIG. 14, the underflow region 93 may have a pipe 95 to provide an outlet 97 for allowing the fluid to exit the filtration tank 87 and pass through hose 99 which leads into the reservoir 83. The outlet 97 may be positioned such that the fluid is taken from the underflow region 93 from a position above the bottom of the underflow region 93 and below the surface of the fluid therein (e.g., when the fluid is close to the top of the underflow region 93). As the fluid is not taken from the top of the underflow region 93, any oil or other floating particles may remain at the surface of the fluid in the filtration tank 87. In some embodiments, the outlet 97 may be belled outwardly to maximize the flow while minimizing entrance losses in the fluid path.

In some embodiments, the underflow region 93 may be in the form of a U-shaped channel 92 as shown in FIGS. 13-14. The channel 92 may comprise a first passage 94 adjacent to the weir wall 91 and a second passage 96 in which the outlet 97 is positioned. The first passage 94 receives the fluid as it flows over the weir wall 91 and guides the fluid to the second passage 96.

Figure 15:
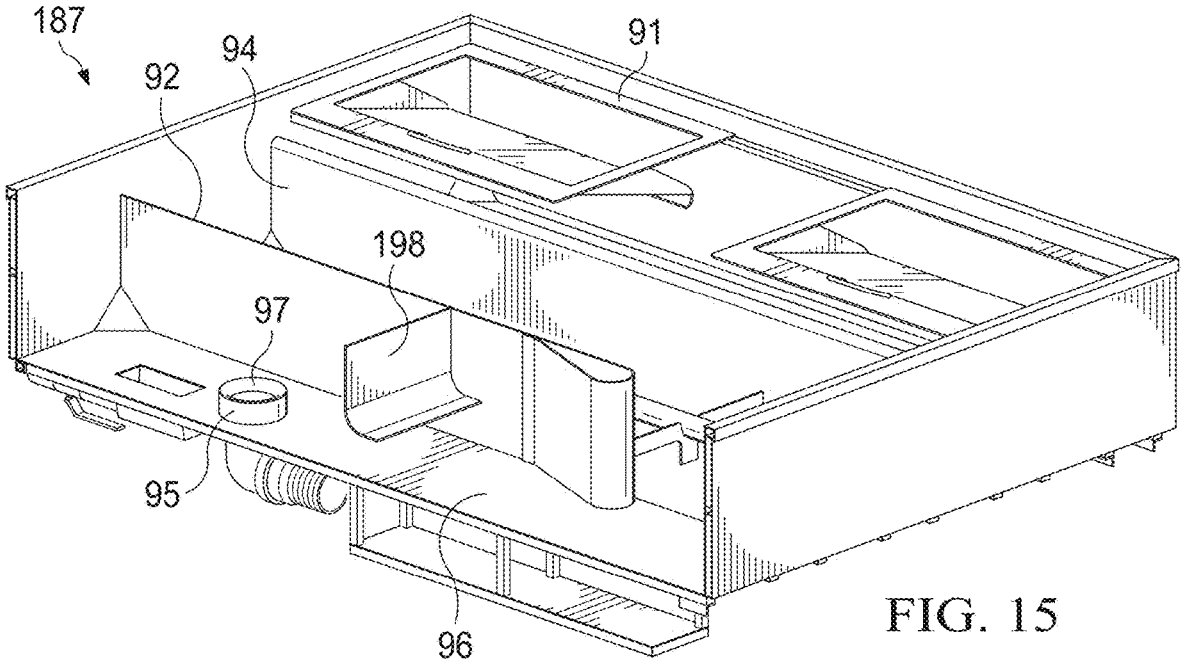
FIG. 15 is a perspective view of an alternative filtration tank having one side cut away.
Figure 16:
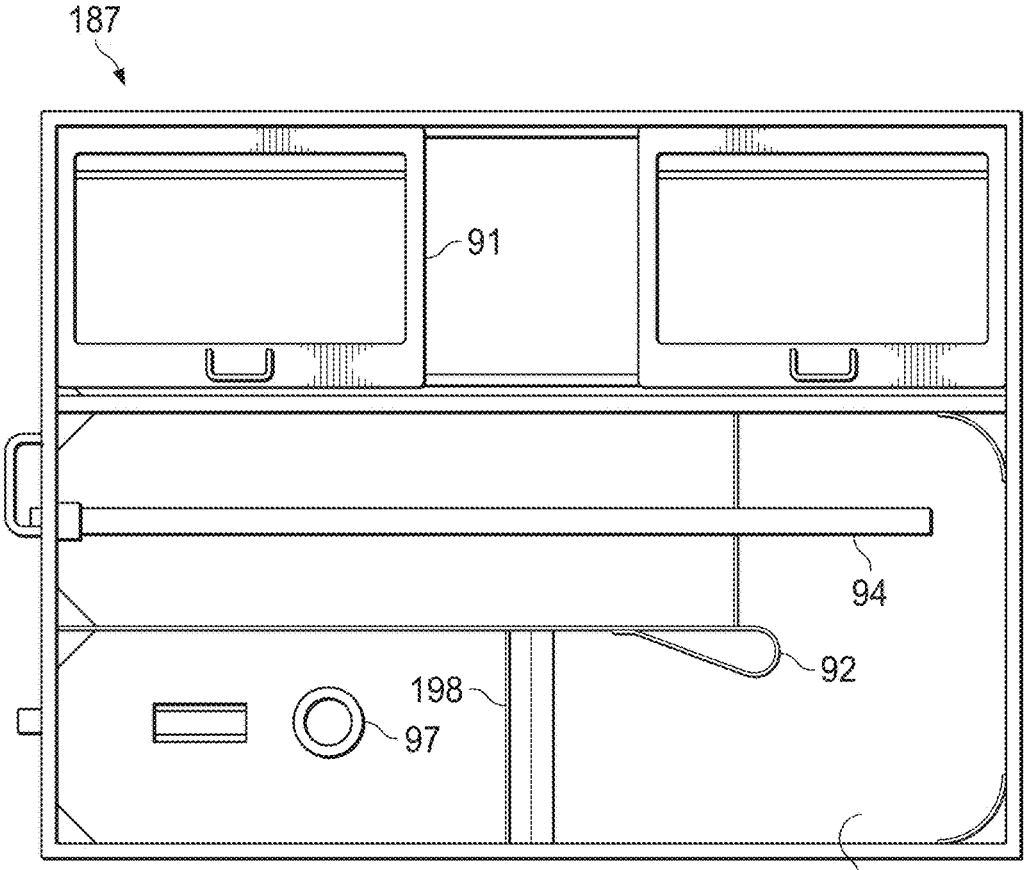
FIG. 16 is a plan view of the filtration tank shown in FIG. 15.

An alternative filtration tank 187 is shown in FIGS. 15 and 16. In this alternative, the second passage 96 may include a barrier 198 extending therein which is upstream from the outlet 97. The barrier 198 may extend vertically downward from the top of the second passage 96 and may terminate before the bottom of the second passage 96. The bottom of the barrier 198 may be shaped to limit mixing of the fluid. While the barrier 198 may allow fluid to flow thereunder, it may prevent the top layer of fluid from flowing past the barrier 198 and towards the outlet 97. As a result, any oil and any floating particles carried in the fluid may be retained by the barrier 198 and thus prevented from flowing towards the outlet 97, thereby improving the quality of the fluid which passes to the reservoir 83.

The reservoir 83 may be connected to the pump 85 and may supply washing solution to the spray system 57. The reservoir 83 may additionally include a heating unit 99 for heating the washing solution.

Each of the filtration tank 87 and reservoir 83 may have a drainage outlet 101. The drainage outlets may be connected to waste and the contents of the filtration tank 87 and reservoir 83 may be drained. Once the filtration tank 87 and reservoir 83 are drained, they may be slidably extended out from the housing 15 allowing an operator to clean and/or service the filtration tank 87 and reservoir 83. Once clean/serviced, they may be pushed back into the housing 15 ready for the next cleaning cycle.

The pump 85 may be housed in the housing 15 and external to the washing chamber 19. The pump 85 may be slidably received in the housing 15 such that it may be readily positioned outside the housing 15 for ease of access when servicing or replacing the pump 85.

Figure 17:
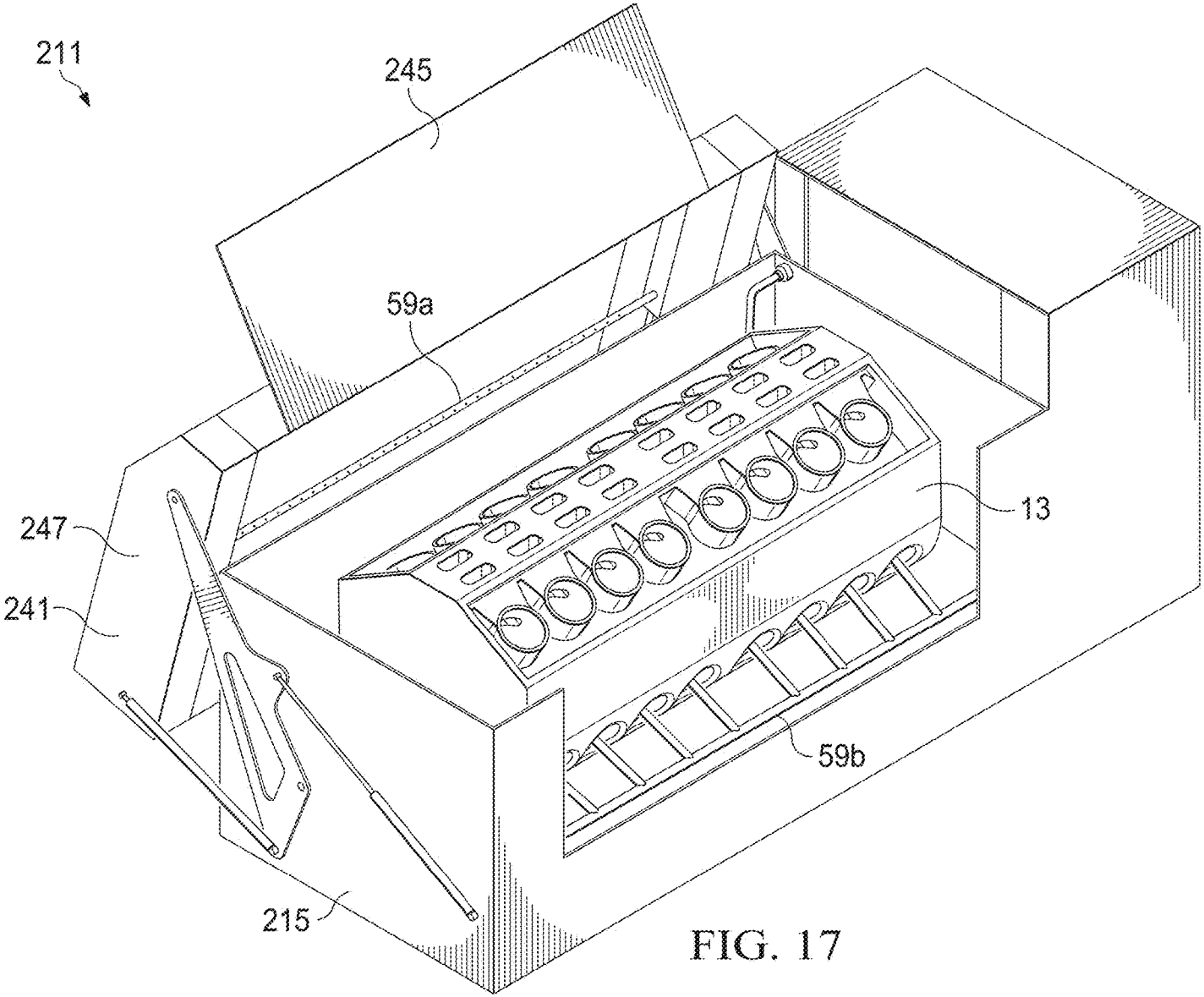
FIG. 17 is a front perspective view of a cleaning apparatus according to a second embodiment of the present disclosure having an engine block located therein, and a lid of the closure in an open position.
Figure 18:
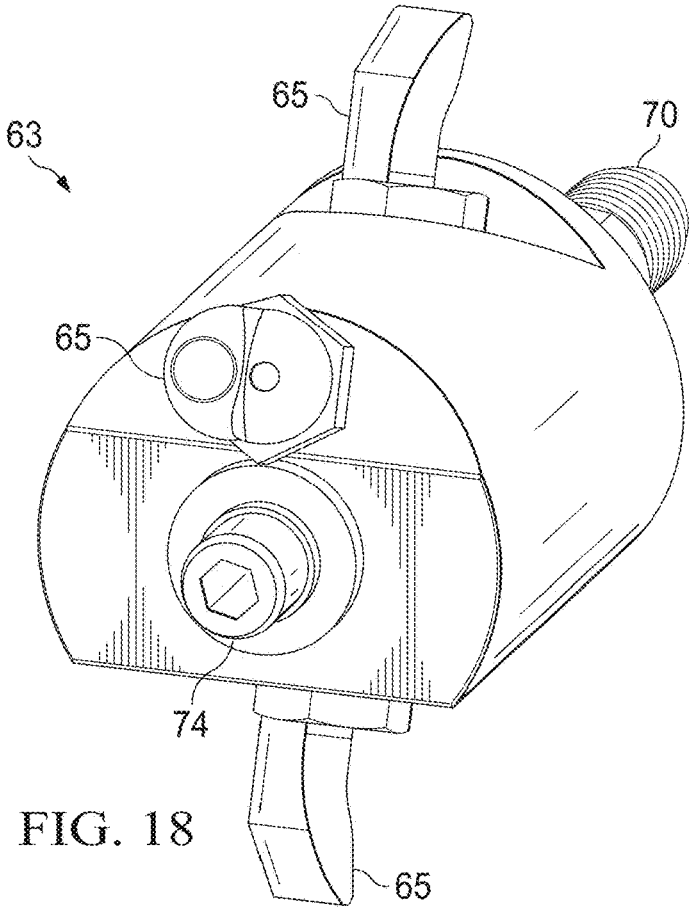
FIG. 18 is a perspective view of a spray head.
Figure 19:
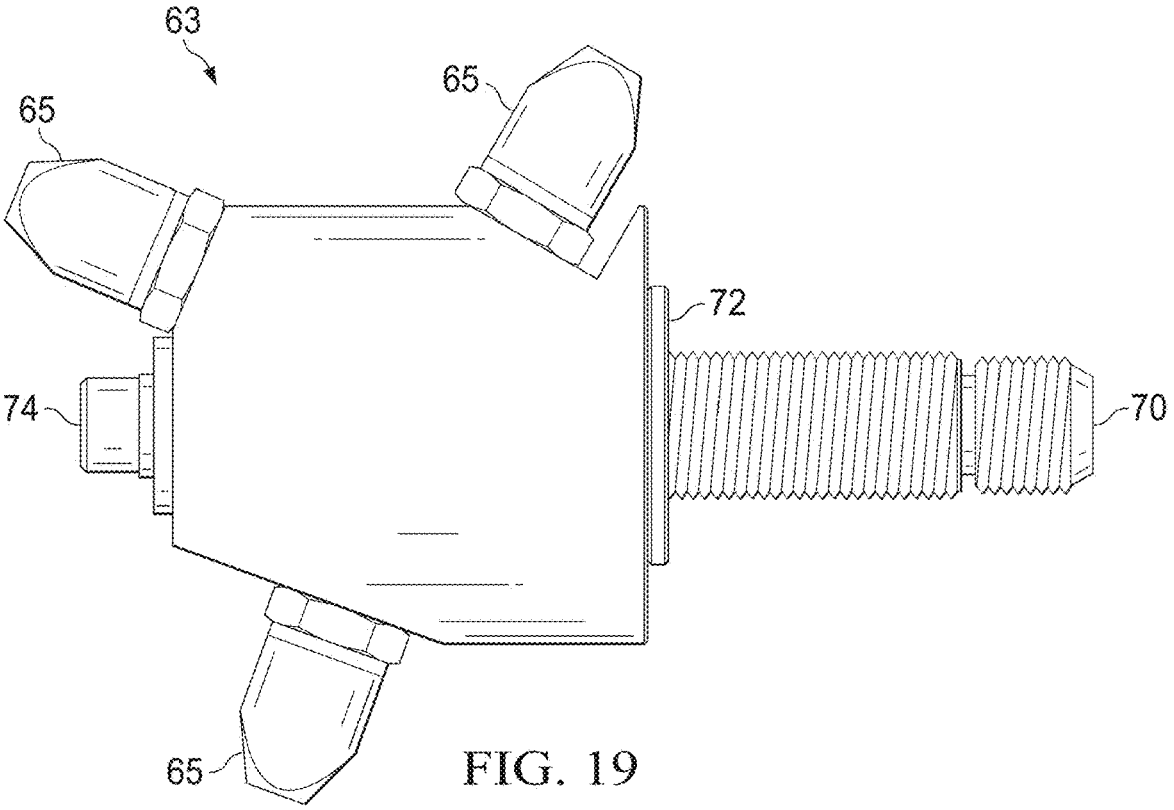
FIG. 19 is a side view of the spray head of FIG. 18.
Figure 20:
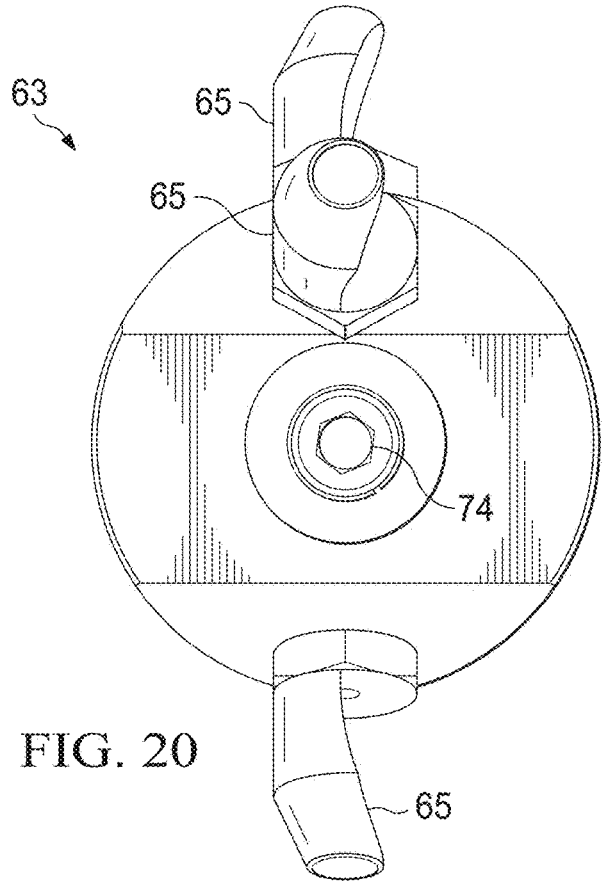
FIG. 20 is a front view of the spray head of FIG. 18.

A cleaning apparatus 211 according to a second embodiment of the present disclosure is illustrated in FIG. 17. For convenience, features of the cleaning apparatus 211 that are similar or correspond to features of the cleaning apparatus 11 of the first embodiment have been referenced with the same reference numerals.

The cleaning apparatus 211 of this embodiment is similar to that of the first embodiment (i.e., cleaning apparatus 11). However, in this second embodiment, a second panel 247 of a lid 241 may be located behind the housing 215. Furthermore, a first panel 245 may rotate outwardly relative to the second panel 247.

Referring now to FIGS. 18-21, each spray head 63 may be rotatable. The rotating spray head 63 according to the present disclosure may utilize a design that addresses several disadvantages of the present art. For example, the spray head 63 according to the present disclosure may be well-suited for use with dirty water or re-used cleaning fluid. Currently available spray heads are not recommended for use with dirty water and/or or re-used cleaning fluid.

Additionally, many existing "tank cleaning" rotating spray heads often rotate very rapidly. The speed at which the spray heads rotate may have a direct inverse correlation to the spray impact on the surface to be cleaned. That is, the faster the spray heads rotate, the lower the spray impact on the surface to be cleaned the spray has. This occurs because, while rotating, the spray nozzle recedes from the surface at a considerable rate that may reduce a relative velocity of the spray relative to the surface. High rotational speed may also reduce a dwell time of spray impacts on the surface. Increased dwell time can significantly improve cleaning efficacy.

Advantageously, the spray head 63 according to the present disclosure is designed to rotate at a substantially low speed governed by the friction imposed by seals 76 and/or by the addition of a non-contact magnetic brake 66 not used by any other spray heads in the market. As such, the spray head 63 is able to be operated at relatively lower speeds, thus maximizing the cleaning effectiveness of the spray head.

Further, some existing slow-rotation tank cleaning spray heads may rely on a turbine and gear system to produce its slow rotation. Advantageously, the spray head 63 according to the present disclosure avoids the use of turbines, gears, and other expensive and complicated equipment for creating and controlling rotational speed. This may enable the spray heads 63 of the present disclosure to also avoid pressure drops ahead of the nozzles 65 created by turbines, which would reduce the pressure and exit velocity of the spray and thus result in a loss of cleaning efficacy. Additionally, the spray heads 63 and nozzles 65 of the present disclosure may avoid wear associated with drive mechanisms as well as jamming and damage caused by dirty water typical of known spray heads.

Because the spray heads 63 of the present disclosure rely upon piston seals 76 instead of bearings (e.g., spindle bearings) for controlling rotation operations, reused cleaning fluid, dirty water, and/or particles below a permissible size may not affect the rotation because there are no tight spaces, crevices, roller elements or narrow clearances in the spray head 63 design. The utilization of piston seals 76 in the spray heads 63 may provide an advantage over existing spray heads because the spray heads 63 can be used in closed cycle cleaning equipment that reuses cleaning fluid many times before being removed as waste.

Many tank cleaning spray heads have numerous jet orifices to ensure spray coverage. The spray head 63 according to the present disclosure however creates maximal coverage using three high-impact spray nozzles 65 as shown in FIGS. 18-21 not found on existing rotating spray heads. Typical three-nozzle designs of other spray heads use "v"-type nozzles or other nozzle types, but do not use a high-impact deflection-type nozzle 65, which offers the highest exit velocity possible, as utilized in the present disclosure and shown in FIGS. 18-21. Thus, the nozzles 65 of the present disclosure may gain an advantage of being more efficient than other spray head nozzles in the way they utilize available pumping capacity (e.g., pressure and flow rate) to produce cleaning outcomes.

The rotating spray head 63 of the present disclosure may be fitted to an end of a spray arm 61 or otherwise operatively coupled to the spray array 59. A fluid delivery hose may also be attached so as to provide cleaning fluid. During operation, the spray heads 63 may be introduced into a substantially enclosed space (e.g., cavities 67, 69 of engine block 13), the interior surfaces of which may require cleaning using high pressure spray of a heated wash fluid. Typically, the cavities 67, 69 may be accessed through side, top, and/or bottom access openings (e.g., cavity opening 71) somewhat larger than the spray head 63 itself. In some embodiments, the spray head 63 may spray every surface within the enclosed space that is within a direct line of sight to the spray head 63 (except perhaps for an area directly behind the spray head 63).

When spraying, a sphere of spray coverage is produced by the spray head 63 using three flat spray nozzles 65. In some embodiments, each nozzle 65 may have an approximately 50 degree spray pattern. The flat spray nozzles 65 may be arranged in a plane at three different angles so that the combined spray pattern is an arc of approximately 150 degrees. The arc may then be rotated or revolved during spraying so that it produces an arc of coverage of approximately 300 degrees. The area (e.g., an approximately 60 degree arc) directly behind the spray head 63 may not be sprayed in order to use available pressure delivery more effectively. Additionally, washing its own support arm 61 is not typically a requirement of cleaning operations, and thus spraying fluid into the openings through which the spray head 63 is introduced may be unnecessary and wasteful.

As seen in FIGS. 18-21, the three nozzles 65 in a plane that produce the approximately 150 degree arc may be further divided into two parts. In this embodiment, the forward directed and more rearward directed nozzles 65 are together on one side of the plane while a more radially directed nozzle (e.g., a center one) may be positioned on an opposing side of the plane. This orientation of nozzles 65 may produce an improved balance of weight and balance of torque, and thus may result in a spray head 63 that is less crowded and easier to both manufacture and assemble. The improved torque balance of the spray head 63, for instance, may reduce stress on the seals 76 which may act as the spray head 63 bearings. This may contribute to the ability of the spray head 63 to dispense fluid with conventional bearings and thus may allow the cleaning apparatus 11 to operate with dirty water and/or reused cleaning fluid. As the two half planes are rotated during operation, the resulting approximately 300 degree arc of spray coverage may be unaffected by the arrangement of the nozzles 65 on opposite sides of the spray head 63.

Figure 21:
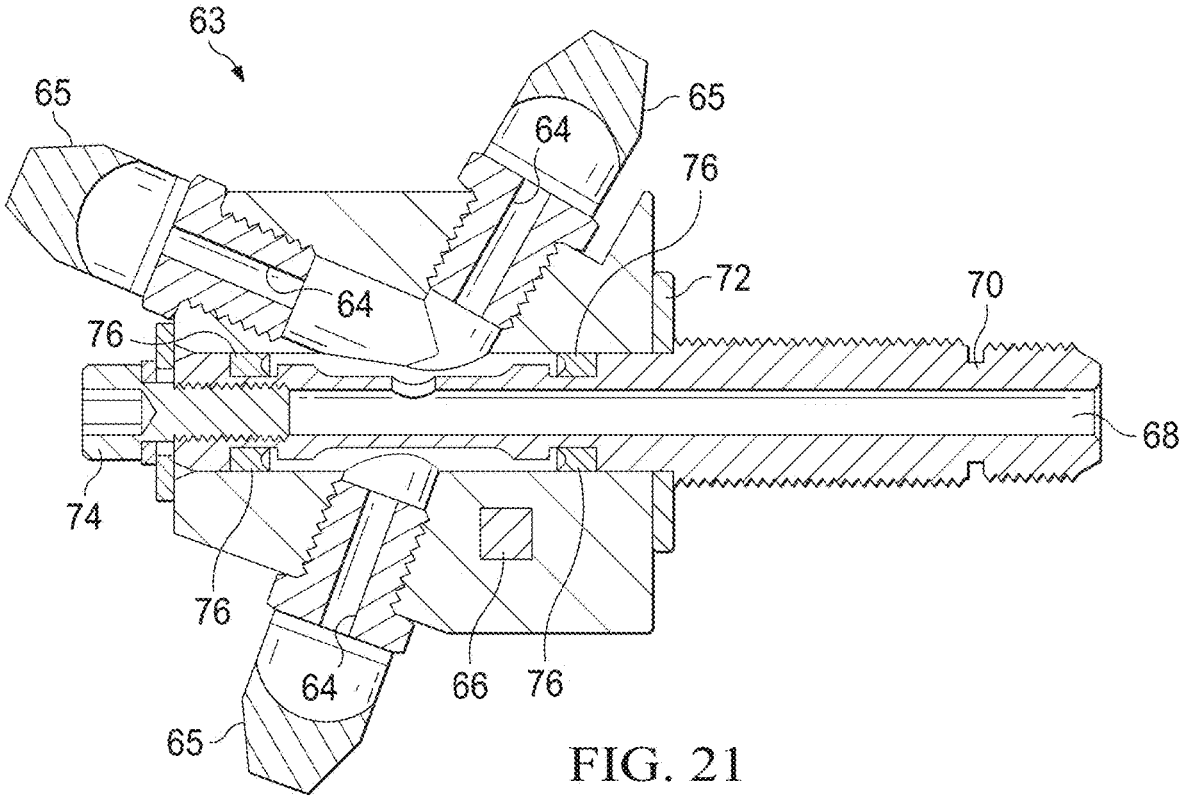
FIG. 21 is a cross-sectional view of the spray head of FIG. 18.

Seen in FIG. 21, the three nozzles 65 may be fed by radial passages 64 in the head which may emanate from a central cavity 68 within the spray head 63 body (and/or other rotating element) that substantially evenly distributes wash fluid. The central cavity 68 in turn may be fed by a number of openings in the central spindle 70 (and/or other stationary element). To prevent pulsing or uneven flow distribution as the spray head 63 rotates, an odd number of spindle openings may be preferred (three are used in one embodiment). They may further be located in an axially offset position relative to the nozzle passages to produce an even more uniform flow. The radial height or clearance of the internal cavities 64, 68 may be designed to be slightly greater than a throat diameter of the nozzles 65 in order to minimize the possibility of particles becoming lodged inside the cavity.

Fluid may be introduced into the spray head 63 through the central cavity 68 of the central spindle 70 (e.g., stationary element) which may be provided with threads for hose fittings and/or other features for connecting to a pressurized wash fluid supply 71. In some embodiments, and in order to minimize pressure losses, the cross-sectional area of the central cavity 68 of the spindle 70 may be at least twice a total cross-sectional area of the throats of the three nozzles 65 combined. Radial passages 64 provided in the spray head 63 for conducting the fluid out of the central cavity 68 and through the nozzles 65 may likewise be larger in total cross sectional area than the throats of the nozzles 65.

In one embodiment, the nozzle throat diameter (e.g., particle passing size) may be approximately 3 mm. Since this may be the smallest passing diameter or fluid space dimension in the entire spray head 63, it may be considered safe to allow particles as large as approximately 1.5 mm to be present in the wash fluid. In some embodiments, however, the fluid may actually be screened to approximately 0.5 mm.

The rotating spray head 63 may be positioned and/or held on the spindle 70 between a polymer washer 72 (e.g., a machined POM acetyl washer, but other appropriate plastics may be used) on one end and a bolt and washer 74 on the other end. This bolt 74 may also double as a plug for the central cavity 68 of the spindle 70, and when removed, the bolt 74 may facilitate cleaning of the spindle 70. The polymer washers 72 may minimize galvanic corrosion by eliminating direct bronze-to-steel wet contact.

The central cavity 68 may be sealed between the rotating head 63 and the stationary spindle 70 using appropriately-sized rotary piston seals 76, which may be constructed from a suitable polymer material compatible with the wash fluid to be used and with the temperatures to be used (in one application, up to 90 degrees C.). In communication with the sealed central cavity 68 may be no crevices and/or clearances with any dimension smaller than the throat diameter of the nozzles 65. This may ensure that no particle can become trapped within the cavity and interfere with the rotation of the spray head 63 through wedging and/or jamming any precision clearances, or interfere with the fluid flow through the spray head 63. Surfaces on the inside of the rotating head in contact with the seals 76 may be polished to a specified surface finish to minimize wear of the seals 76.

The spray head 63 may be constructed to have a defined service life, which may be limited by the inevitable gradual erosion of the spray nozzles 65 and/or by wear of the seals 76. When the cleaning effectiveness falls below minimum requirements, the spray head 63 may be removed from service and disassembled. It may be cleaned and re-assembled using new nozzles 65 and/or seals 76, and returned to service. The spray head 63 may be designed to be easily and readily disassembled and re-assembled in order to minimize the time and labour required for refurbishment. The spray head 63 design may include a purpose-made seal insertion tool and specific features on the spindle 70 provided to simplify the task of seal replacement. For example, these features may include radiusing and/or chamfering of specific edges.

The rotation of the spray head 63 may be produced by reaction forces resulting from the deflection of the spray nozzles 65. These nozzles 65 may operate by forming a round jet and allowing the jet to impact a curved machined surface at a slight angle that is formed integrally to the nozzle 65. The force of the glancing impact may flatten the spray into a flat pattern with a defined angle of spread. A by-product of deflecting and flattening the spray jet is that there is a slight transverse force generated by the angle of deflection. The spray head 63 may utilize this collateral force to create a torque on the spray head 63 sufficient to overcome the friction of the seals 76 and thus may rotate.

Because seal friction may vary, the speed of rotation of the spray head 63 cannot be precisely specified. For most purposes, the speed of rotation may not need to be specified within a narrow margin. It may only need to be limited to speeds that equate to tangential nozzle speeds that are much less than the exit velocity of the spray. For example, at approximately 100 psi, a theoretical maximum spray velocity may be approximately 37 m/s. A nozzle tip speed of approximately 37 m/s may result from rotational speed of approximately 5800 RPM. Thus if the rotational speed is restrained to less than approximately 100 RPM or approximately <2% of the maximum rotational speed, there may be no measurable loss of cleaning efficacy.

The spray head may implement speed control using a magnetic or eddy current brake (e.g., magnetic brake 66). Because the body of the spray head 63 may be bronze (e.g., gunmetal bronze 83600A or LG2, 5% Sn, 5% Zn which may have desired machinability and corrosion resistance properties), the spray head 63 may be both conductive and non-magnetic and thus ideally suited for magnetic braking. Aluminum and/or other materials may also be utilized.

At zero and/or low rotational speeds, one or more magnetic brakes 66 of the spray head 63 may have zero or little effect, as the braking force may be lower than the seal friction. However, as the rotational speed of the spray head 63 increases, magnetic resistance may increase proportionally. In some embodiments, the magnetic brake 66 may produce a near-perfect viscous frictional force that effectively limits the top rotational speed of the spray head 63. The maximum theoretical top rotational speed of the spray head 63 may be fixed by the fluid pressure, the strength and number of magnetic elements, and/or the adjustable gap between the magnets (e.g., magnetic brake 66) and the bronze body of the spray head. A typical setup may limit the rotational speed of the spray head 63 to approximately 50 RPM.

Modifications and variations such as would be apparent to the skilled addressee are considered to fall within the scope of the present disclosure. The present disclosure is not to be limited in scope by any of the specific embodiments described herein. These embodiments are intended for the purpose of exemplification only. Functionally equivalent products, formulations and methods are clearly within the scope of the disclosure as described herein.

While the present disclosure has been shown and described with reference to certain exemplary embodiments thereof, it will be understood by those skilled in the art that various changes in form and details may be made therein without departing from the spirit and scope of the disclosure as defined by the appended claims. Reference to positional descriptions, such as lower and upper, are to be taken in context of the embodiments depicted in the figures, and are not to be taken as limiting the disclosure to the literal interpretation of the term but rather as would be understood by the skilled addressee.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprise", "comprises," "comprising," "including," and "having," or variations thereof are inclusive and therefore specify the presence of stated features, integers, steps, operations, elements, and/or components, but do not preclude the presence or addition of one or more other features, integers, steps, operations, elements, components, and/or groups thereof.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A cleaning apparatus for cleaning a part, the cleaning apparatus comprising:

a housing defining a washing chamber, the washing chamber having an opening through which parts may be loaded and unloaded into and out of the washing chamber;

a support cradle configured to support a part to be cleaned, the support cradle being located in the washing chamber;

a spray system configured to direct a washing solution to clean the part in the washing chamber, the spray system comprising a spray array, the spray array comprising a plurality of spray heads that are fluidly connected to a plurality of spray arms that are configured to receive the washing solution from a washing solution reservoir, each spray head comprising:

(a) a central spindle extending away from and fluidly connected to one of the spray arms; and (b) a plurality of nozzles that each extend away from the central spindle and are each fluidly connected to the central spindle through a separate radial passage, the plurality of nozzles configured to receive the washing solution from one of the spray arms through the central spindle, wherein each radial passage for each nozzle is oriented at a different angle with respect to the remaining nozzles of the spray head, wherein the washing solution is directed through the plurality of nozzles to clean the part in the washing chamber, wherein the spray system is configured to position at least one spray head at a first position and a second position, wherein the first position and the second position are defined within first and second cavities, respectively, of the part to be cleaned, wherein each spray head is configured to rotate about the same axis as the central spindle, individually with respect to the remaining of the plurality of spray heads; and a closure which provides controlled access to the washing chamber through the opening, the closure being movable between a closed position to sealingly close the opening, and an open position to allow for loading and unloading of the part into and out of the washing chamber, wherein when in an open position the closure is supported in a position away from the opening such that the closure does not provide an obstruction to the opening.

2. The cleaning apparatus of claim 1, wherein the part comprises an engine block.

3. The cleaning apparatus of claim 1, wherein each nozzle comprises a substantially flat surface.

4. The cleaning apparatus of claim 1, wherein the closure comprises a collapsible lid.

5. A cleaning apparatus for cleaning a part, the cleaning apparatus comprising:

a housing defining a washing chamber, the washing chamber having an opening through which a part may be loaded and unloaded into and out of the washing chamber;

a support cradle adapted to support the part to be cleaned, the support cradle being located in the washing chamber;

a closure which provides controlled access to the washing chamber through the opening, the closure being movable between a closed position to sealingly close the opening, and an open position to allow for loading and unloading of the part into and out of the washing chamber; and a spray system configured to direct a washing solution to clean the part in the washing chamber, the spray system comprising a plurality of spray arrays, wherein the spray system is operable to move from a retracted position to a cleaning position, wherein each spray array comprises a plurality of spray heads, and a plurality of independently rotatable spray heads that are fluidly connected to a plurality of spray arms that are configured to receive the washing solution from a washing solution reservoir, each spray head comprising:

(a) a central spindle extending away from and fluidly connected to one of the spray arms; and (b) a plurality of nozzles that each extend away from the central spindle and are each fluidly connected to the central spindle through a separate radial passage, the plurality of nozzles configured to receive the washing solution from one of the spray arms through the central spindle, wherein each radial passage for each nozzle is oriented at a different angle with respect to the remaining nozzles of the spray head, wherein the washing solution is directed through the plurality of nozzles to clean the part in the washing chamber, wherein each spray head is configured to rotate about the same axis as the central spindle, individually with respect to the remaining of the plurality of spray heads.

6. The cleaning apparatus of claim 5, wherein the part comprises an engine block.

7. The cleaning apparatus of claim 5, wherein the spray heads comprise a plurality of nozzles through which the washing solution is directed to clean the part in the washing chamber.

8. The cleaning apparatus of claim 5, wherein the spray heads comprise at least one of a piston seal and a magnetic brake for controlling rotation of the spray head.

9. The cleaning apparatus of claim 8, wherein the closure comprises a collapsible lid.

10. A cleaning apparatus for cleaning a part, the cleaning apparatus comprising:

a housing defining a washing chamber, the washing chamber having an opening through which the part may be loaded and unloaded into and out of the washing chamber;

a support cradle adapted to support the part to be cleaned, the support cradle being located in the washing chamber;

a spray system configured to direct a washing solution to clean the part in the washing chamber, the spray system comprising a spray array, the spray array comprising a plurality of spray heads that are fluidly connected to a plurality of spray arms configured to receive the washing solution from a washing solution reservoir, each spray head comprising:

(a) a central spindle extending away from and fluidly connected to one of the spray arms; and (b) a plurality of nozzles that each extend away from the central spindle and are each fluidly connected to the central spindle through a separate radial passage, the plurality of nozzles configured to receive the washing solution from one of the spray arms through the central spindle, wherein each radial passage for each nozzle is oriented at a different angle with respect to the remaining nozzles of the spray head, wherein the washing solution is directed through the plurality of nozzles to clean the part in the washing chamber, wherein the spray system is configured to position at least one spray head at a first position and a second position, wherein the first position and the second position are defined within first and second cavities, respectively, of the part to be cleaned, wherein each spray head is configured to rotate about the same axis as the central spindle, individually with respect to the remaining of the plurality of spray heads;

a fluid supply system comprising a filtration system and a reservoir wherein the filtration system is configured to treat the washing solution before it passes into the reservoir, and further wherein the treated washing solution may be reused in the spray system; and a closure which provides controlled access to the washing chamber through the opening, the closure being movable between a closed position to sealingly close the opening, and an open position to allow for loading and unloading of the part into and out of the washing chamber, wherein when in an open position the closure is supported in a position away from the opening such that the closure does not provide an obstruction to the opening.

11. The cleaning apparatus of claim 10, wherein the part comprise an engine block.

12. The cleaning apparatus of claim 10, wherein the spray heads comprise a plurality of nozzles through which the washing solution is directed to clean the part in the washing chamber.

13. The cleaning apparatus of claim 10, wherein the spray head comprises at least one of a piston seal and a magnetic brake for controlling rotation of the spray head.

14. The cleaning apparatus of claim 10, wherein the closure comprises a collapsible lid.

* * * * *